US010378237B2

(12) United States Patent
Bacon et al.

(10) Patent No.: US 10,378,237 B2
(45) **Date of Patent: *Aug. 13, 2019**

(54) TOUCH PAD LOCK ASSEMBLY WITH CLUTCH SYSTEM

(71) Applicant: BAUER PRODUCTS, INC., Grand Rapids, MI (US)

(72) Inventors: Bruce C. Bacon, Rockford, MI (US); Chi-Tsan Wang, Taipei (TW)

(73) Assignee: BAUER PRODUCTS, INC., Grand Rapids, MI (US)

( * ) Notice: Subject to any disclaimer, the term of this patent is extended or adjusted under 35 U.S.C. 154(b) by 20 days.

This patent is subject to a terminal disclaimer.

(21) Appl. No.: 15/716,571

(22) Filed: Sep. 27, 2017

(65) Prior Publication Data

US 2018/0016810 A1 Jan. 18, 2018

Related U.S. Application Data

(63) Continuation-in-part of application No. 14/740,640, filed on Jun. 16, 2015, now Pat. No. 9,940,767, which
(Continued)

(51) Int. Cl.
*E05B 59/00* (2006.01)
*E05B 63/14* (2006.01)
(Continued)

(52) U.S. Cl.
CPC ..... *E05B 17/0083* (2013.01); *E05B 13/10* (2013.01); *E05B 17/10* (2013.01);
(Continued)

(58) Field of Classification Search
CPC ..... E05B 81/25; E05B 83/44; E05B 85/22; E05B 2047/0086; E05B 17/0083;
(Continued)

(56) References Cited

U.S. PATENT DOCUMENTS 145,835 A 12/1873 Bissell
374,391 A 12/1887 Born
(Continued)

FOREIGN PATENT DOCUMENTS

DE 26 29 332 1/1978
GB 2 123 474 2/1984

OTHER PUBLICATIONS

Tri/Mark, "Travel Trailer Latch Dead Bolt Option—60-200 Series 60-250 Series," New Hampton, Iowa (date unknown, prior to Jun. 11, 2002).

(Continued)

*Primary Examiner* — Lloyd A Gall
(74) *Attorney, Agent, or Firm* — Price Heneveld LLP

(57) ABSTRACT

A lock assembly comprises a housing, a handle, and a latch plunger operably connected with the handle. An exterior key lock and interior lock knob have a locked and unlocked position. A lock cam is rotatably and operably connected with the key lock and interior lock knob for rotation therewith. A crank arm of the lock cam is operatively coupled with a deadbolt lock movably mounted in the housing for shifting between a locked position and an unlocked position. The deadbolt lock is also operably coupled with a motor, wherein a motor cam clutch is operably coupled with the motor and operably interposed between the lock cam and the motor, wherein the motor cam clutch allows rotation of the lock cam between the locked and unlocked positions without rotating the motor cam clutch or a motor shaft of the motor.

32 Claims, 22 Drawing Sheets

Related U.S. Application Data is a continuation-in-part of application No. 13/424,512, filed on Mar. 20, 2012, now Pat. No. 9,085,919, which is a continuation-in-part of application No. 12/639,516, filed on Dec. 16, 2009, now Pat. No. 8,347,667, which is a continuation-in-part of application No. 13/368,778, filed on Feb. 8, 2012, now Pat. No. 8,393,187, which is a continuation-in-part of application No. 12/952,230, filed on Nov. 23, 2010, now Pat. No. 8,186,191.

(60) Provisional application No. 61/203,403, filed on Dec. 22, 2008, provisional application No. 61/440,895, filed on Feb. 9, 2011, provisional application No. 61/264,935, filed on Nov. 30, 2009.

(51) Int. Cl.

| | |
|---|---|
| ***E05C 1/04*** | (2006.01) |
| ***E05B 17/00*** | (2006.01) |
| ***E05B 17/10*** | (2006.01) |
| ***E05B 81/82*** | (2014.01) |
| ***E05B 47/02*** | (2006.01) |
| ***E05B 81/06*** | (2014.01) |
| ***E05B 81/24*** | (2014.01) |
| ***E05B 47/00*** | (2006.01) |
| ***E05B 81/66*** | (2014.01) |
| ***E05B 85/22*** | (2014.01) |
| ***E05C 1/14*** | (2006.01) |
| ***E05B 13/10*** | (2006.01) |
| ***G07C 9/00*** | (2006.01) |
| *E05B 81/18* | (2014.01) |
| *E05B 85/18* | (2014.01) |
| *E05B 83/44* | (2014.01) |

(52) U.S. Cl.

CPC ..... *E05B 47/0012* (2013.01); *E05B 47/026* (2013.01); *E05B 59/00* (2013.01); *E05B 81/06* (2013.01); *E05B 81/25* (2013.01); *E05B 81/66* (2013.01); *E05B 81/77* (2013.01); *E05B 81/82* (2013.01); *E05B 85/22* (2013.01); *E05C 1/14* (2013.01); *G07C 9/00126* (2013.01); *G07C 9/00174* (2013.01); *E05B 63/14* (2013.01); *E05B 81/18* (2013.01); *E05B 83/44* (2013.01); *E05B 85/18* (2013.01); *E05B 2047/0086* (2013.01); *Y10T 70/7068* (2015.04)

(58) Field of Classification Search

CPC ..... E05B 17/10; E05B 81/66; E05B 81/77; E05B 85/18; E05B 81/18; E05B 47/0012; E05B 13/10; E05B 59/00; E05B 47/026; E05B 81/82; E05B 81/06; E05B 63/14; E05C 1/14; Y10T 70/7068; G07C 9/00174; G07C 9/00126

USPC ..... 70/107–111, 278.7, 279.1, 278.1, 208, 70/210, 256, 257, 277, 280–283, 283.1, 70/278.2, 278.3, 218, 222, 223; 292/144, 292/DIG. 31

See application file for complete search history.

(56) References Cited

U.S. PATENT DOCUMENTS

| | | | | |
|---|---|---|---|---|
| 745,042 | A | | 11/1903 | Daves |
| 1,071,567 | A | | 8/1913 | Outwater |
| 1,141,463 | A | | 6/1915 | Hurd |
| 1,478,381 | A | | 12/1923 | Crimmel |
| 1,593,011 | A | | 7/1926 | Bourgon |
| 1,596,992 | A | | 8/1926 | Ognowicz |
| 1,654,489 | A | | 12/1927 | Teich |
| 1,678,498 | A | | 7/1928 | Crimmel |
| 1,805,891 | A | | 5/1931 | Shinn |
| 1,807,804 | A | | 6/1931 | Stone |
| 1,845,732 | A | | 2/1932 | Tournier et al. |
| 1,964,066 | A | | 6/1934 | Kaszmaul |
| 2,022,718 | A | | 12/1935 | Heins |
| 2,097,407 | A | | 10/1937 | Spinello |
| 2,112,372 | A | | 3/1938 | Lofgren |
| 2,201,957 | A | | 5/1940 | North |
| 2,202,056 | A | | 5/1940 | Kandetzki |
| 2,241,785 | A | | 5/1941 | Lofgren |
| 2,253,547 | A | | 8/1941 | Adams |
| 2,263,180 | A | | 11/1941 | Lofgren |
| 2,303,624 | A | | 12/1942 | Edwards et al. |
| 2,322,948 | A | | 6/1943 | Lofgren |
| 2,324,406 | A | | 7/1943 | Lofgren et al. |
| 2,460,709 | A | | 2/1949 | Navarro |
| 2,642,300 | A | | 6/1953 | Pelcin |
| 2,668,076 | A | | 2/1954 | Troche et al. |
| 2,735,706 | A | | 2/1956 | Pelcin |
| 2,871,048 | A | | 1/1959 | Balogh |
| 2,900,204 | A | | 8/1959 | Pelcin |
| 2,987,908 | A | | 6/1961 | Pelcin |
| 3,019,632 | A | | 2/1962 | Russell |
| 3,027,188 | A | | 3/1962 | Eickstadt |
| 3,080,743 | A | | 3/1963 | Stansberry |
| 3,095,726 | A | | 7/1963 | Schlage |
| 3,111,833 | A | | 11/1963 | Dettmer |
| 3,190,093 | A | | 6/1965 | Schlage |
| 3,234,765 | A | | 2/1966 | Kerr |
| 3,283,549 | A | | 11/1966 | Mees |
| 3,438,227 | A | | 4/1969 | Wolniak |
| 3,514,979 | A | | 6/1970 | Wiesmann |
| D218,672 | S | | 9/1970 | Lauper |
| 3,563,071 | A | | 2/1971 | Barger |
| 3,580,016 | A | | 5/1971 | Kerr |
| 3,649,095 | A | * | 3/1972 | Gunzburg ..... E05B 65/46 312/215 |
| 3,668,907 | A | | 6/1972 | Pastva, Jr. |
| 3,707,862 | A | | 1/1973 | Pastva, Jr. |
| D230,132 | S | | 1/1974 | Pastva, Jr. |
| 3,782,141 | A | | 1/1974 | Doerrfeld |
| 3,789,550 | A | | 2/1974 | Seiwert |
| 3,998,080 | A | | 12/1976 | Fane |
| 4,045,064 | A | | 8/1977 | Okada |
| 4,052,092 | A | | 10/1977 | Bergen |
| 4,075,879 | A | | 2/1978 | Christopher |
| 4,138,869 | A | | 2/1979 | Pelcin |
| 4,158,299 | A | | 6/1979 | Grabner et al. |
| 4,237,709 | A | | 12/1980 | Krugener et al. |
| 4,276,760 | A | | 7/1981 | Nolin |
| 4,309,884 | A | | 1/1982 | Davis |
| 4,312,197 | A | | 1/1982 | Carrion et al. |
| 4,312,202 | A | | 1/1982 | Pastva, Jr. et al. |
| 4,413,493 | A | | 11/1983 | Meinsen et al. |
| 4,418,552 | A | | 12/1983 | Nolin |
| 4,420,954 | A | | 12/1983 | Hieronymi et al. |
| 4,438,964 | A | | 3/1984 | Peters |
| 4,443,032 | A | | 4/1984 | Bonassi |
| 4,474,393 | A | | 10/1984 | Kimura |
| 4,508,379 | A | | 4/1985 | Mochida |
| D281,665 | S | | 12/1985 | Winderman et al. |
| 4,630,457 | A | | 12/1986 | Kincaid et al. |
| 4,653,143 | A | | 3/1987 | Ketelhut et al. |
| 4,677,834 | A | | 7/1987 | Hicks |
| 4,683,741 | A | | 8/1987 | Fields |
| 4,689,976 | A | | 9/1987 | Larsen |
| 4,715,201 | A | | 12/1987 | Craig |
| 4,725,085 | A | | 2/1988 | Hu et al. |
| 4,732,417 | A | | 3/1988 | Yang |
| 4,762,348 | A | | 8/1988 | Matsumoto |
| 4,773,683 | A | | 9/1988 | Nakamura |
| 4,778,206 | A | | 10/1988 | Matsumoto et al. |
| 4,821,539 | A | | 4/1989 | Steinbach |
| 4,850,209 | A | | 7/1989 | Weinerman et al. |
| D303,617 | S | | 9/1989 | Russell et al. |
| D303,621 | S | | 9/1989 | Russell et al. |
| D303,618 | S | | 10/1989 | Russell et al. |

(56) References Cited

U.S. PATENT DOCUMENTS

D303,922 S 10/1989 Russell et al.
D304,155 S 10/1989 Russell et al.
4,892,338 A 1/1990 Weinerman et al.
4,934,800 A 6/1990 Choi
4,936,122 A 6/1990 Osada
4,966,018 A 10/1990 Hauber
4,967,305 A 10/1990 Murrer et al.
4,976,123 A 12/1990 Ceron et al.
D314,131 S 1/1991 Russell et al.
4,986,576 A 1/1991 Anderson
5,027,625 A 7/1991 Krachten
5,042,853 A 8/1991 Gleason et al.
5,058,937 A 10/1991 Miehe et al.
5,060,991 A 10/1991 Davidian et al.
5,074,009 A 12/1991 Simonton et al.
5,119,654 A 6/1992 Ceron et al.
5,127,686 A 7/1992 Gleason et al.
5,174,456 A 12/1992 Grody
5,180,201 A 1/1993 Hauber
5,182,929 A 2/1993 Myers
D339,050 S 9/1993 Gleason et al.
5,265,453 A 11/1993 Konii
5,265,920 A 11/1993 Kaup et al.
5,299,844 A 4/1994 Gleason
5,301,989 A 4/1994 Dallmann et al.
D346,731 S 5/1994 Larsen et al.
5,484,178 A 1/1996 Sandhu et al.
5,493,881 A * 2/1996 Harvey ..... E05B 47/0607 292/144
D369,084 S 4/1996 McConnell et al.
D371,500 S 7/1996 McConnell et al.
5,531,498 A 7/1996 Kowall
D373,298 S 9/1996 Miehe et al.
5,564,295 A 10/1996 Weinerman et al.
5,586,459 A 12/1996 Bullock et al.
5,586,795 A 12/1996 Sasaki
5,595,076 A * 1/1997 Weinerman ..... E05B 5/00 292/34
5,606,882 A 3/1997 Larsen et al.
5,611,227 A 3/1997 Solovieff
5,697,238 A 12/1997 Oike
5,711,506 A 1/1998 Stillwagon
D390,086 S 2/1998 Weinerman et al.
5,715,713 A * 2/1998 Aubry ..... E05B 81/06 292/201
D394,373 S 5/1998 Weinerman et al.
5,775,146 A 7/1998 Edwards et al.
5,799,520 A 9/1998 Laabs et al.
5,875,948 A 3/1999 Sadler
5,884,948 A 3/1999 Weinerman et al.
5,927,773 A 7/1999 Larsen
5,964,110 A 10/1999 Crocco et al.
5,975,597 A 11/1999 Makiuchi et al.
6,032,500 A 3/2000 Collard, Jr. et al.
6,042,159 A 3/2000 Spitzley
6,059,329 A 5/2000 Spitzley
6,101,853 A 8/2000 Herr
6,108,979 A 8/2000 Saffran et al.
6,138,883 A 10/2000 Jackson
6,203,086 B1 3/2001 Dirks
D440,481 S 4/2001 Bacon
6,220,649 B1 4/2001 Rife
6,257,030 B1 7/2001 Davis
6,309,008 B1 10/2001 Bacon
6,363,577 B1 4/2002 Spitzley
6,382,006 B1 5/2002 Field et al.
6,409,234 B1 6/2002 Larsen et al.
6,513,353 B1 2/2003 Weinerman et al.
6,604,393 B2 8/2003 Larsen et al.
6,629,441 B2 10/2003 Lavergne
6,651,467 B1 11/2003 Weinerman et al.
D485,155 S 1/2004 Bacon
6,685,240 B2 2/2004 Bacon
6,701,761 B1 3/2004 Chang et al.
6,708,537 B1 3/2004 Eschweiler et al.
6,758,503 B2 7/2004 Sadler
6,845,641 B2 1/2005 Hsieh
6,854,304 B2 2/2005 Linares
6,857,298 B2 2/2005 Linares
6,962,375 B2 11/2005 Linares
7,028,514 B2 4/2006 Banks
7,034,655 B2 4/2006 Magner et al.
7,097,216 B2 6/2006 Lane
7,070,216 B2 7/2006 von zur Muehlen
D529,367 S 10/2006 Zweibohnmer et al.
7,119,709 B2 10/2006 Magner et al.
7,155,946 B2 1/2007 Lee et al.
7,168,755 B2 1/2007 Munezane
7,236,085 B1 6/2007 Aronson et al.
7,237,812 B2 7/2007 Tweedy
7,363,786 B2 4/2008 Terhaar et al.
7,401,484 B1 7/2008 Holmes et al.
7,520,152 B2 4/2009 Sabo et al.
7,819,444 B2 10/2010 Kagawa et al.
7,874,972 B2 1/2011 Kayasaka et al.
8,141,400 B2 * 3/2012 Sorensen ..... E05B 47/068 340/5.54
8,186,191 B2 5/2012 Bacon
8,347,667 B2 1/2013 Bacon
8,393,187 B2 3/2013 Bacon
8,733,139 B2 5/2014 Pickar
8,876,172 B2 * 11/2014 Denison ..... E05B 47/0012 292/144
9,085,919 B2 * 7/2015 Bacon ..... E05B 13/10
9,940,767 B2 * 4/2018 Bacon ..... E05B 81/82
2002/0092331 A1 7/2002 Huang
2003/0010073 A1 1/2003 Larsen et al.
2003/0226384 A1 12/2003 Shedd et al.
2004/0040353 A1 3/2004 Yu et al.
2004/0074269 A1 4/2004 Lee
2004/0134245 A1 7/2004 Jasper
2005/0044908 A1 3/2005 Min
2005/0179517 A1 8/2005 Harms et al.
2006/0049647 A1 3/2006 von zur Muehlen
2006/0260203 A1 11/2006 Wong et al.
2007/0001479 A1 1/2007 Fukuda et al.
2007/0056338 A1 3/2007 Sabo et al.
2007/0163312 A1 7/2007 Shen
2008/0127686 A1 6/2008 Hwang
2008/0258867 A1 10/2008 Harris et al.
2010/0300162 A1 12/2010 Cappuccio et al.
2010/0321173 A1 12/2010 Magner et al.

OTHER PUBLICATIONS

Tri/Mark, "Tri/Mark Designers & Manufacturers of Vehicle Hardware Products," New Hampton, Iowa (1996).

* cited by examiner

TOUCH PAD LOCK ASSEMBLY WITH CLUTCH SYSTEM

CROSS-REFERENCE TO RELATED APPLICATIONS AND CLAIM TO PRIORITY

This application is a continuation-in-part of and claims priority under 35 U.S.C. § 120 to commonly assigned and related U.S. Pat. No. 9,940,767, issued Apr. 10, 2018, which further was a continuation-in-part of and claims priority under 35 U.S.C. § 120 to commonly assigned and related U.S. Pat. No. 9,085,919, issued Jul. 21, 2015, entitled TOUCH PAD LOCK ASSEMBLY, which further was a continuation-in-part of and claimed priority under 35 U.S.C. § 120 to related U.S. Pat. No. 8,347,667, issued Jan. 8, 2013, entitled LOCK ASSEMBLY FOR CLOSURES AND THE LIKE, which claimed priority under 35 U.S.C. § 119(e) to U.S. Provisional Application No. 61/203,403, filed Dec. 22, 2008; and further was a continuation-in-part of and claimed priority under 35 U.S.C. § 120 to commonly assigned and related U.S. Pat. No. 8,186,191, issued May 29, 2012, entitled REMOTELY OPERATED LOCK ASSEMBLY FOR CLOSURES AND THE LIKE, which claimed priority under 35 U.S.C. § 119(e) to U.S. Provisional Patent Application No. 61/264,935, filed Nov. 30, 2009, the entire disclosures of which are incorporated herein by reference. Commonly assigned and related U.S. Pat. No. 9,085,919 was also a continuation-in-part application and claimed priority under 35 U.S.C. § 120 to commonly assigned and related U. S. Pat. No. 8,393,187, issued Mar. 12, 2013, entitled REMOTELY OPERATED LOCKING HANDLE LATCH ASSEMBLY, which claimed priority under 35 U.S.C. § 119(e) of U.S. Provisional Application No. 61/440,895, filed Feb. 9, 2011, the entire disclosure of which is incorporated herein by reference.

BACKGROUND OF THE DISCLOSURE

The present disclosure relates to lock assemblies for movable closures and the like, and, in particular, to a lock assembly that can be actuated manually, via a touch pad, or via a remote control.

Lock assemblies are generally well-known in the art, and are typically flush mounted on an associated closure or door to facilitate selectively shifting the closure between an open unlocked position and a closed locked position. Paddle handle assemblies are used widely on entry doors for recreational vehicles, motor homes, and the like, and in such applications require that the latch mechanism be accessible and operable from both the inside and the outside of the vehicle. Paddle handle assemblies often include a deadbolt lock for maximum security.

Heretofore, paddle handle assemblies have proven generally effective, although they experience certain drawbacks. For example, most prior art paddle handle assemblies require that the latch lock and the deadbolt lock be actuated through manual lock cylinders and key locks. Also, such prior art paddle handle assemblies are not particularly adapted for use with remotely operated signaling devices, which have become quite popular in the vehicle industry. Furthermore, some prior art paddle handle assemblies experience a problem in maintaining the alignment between the deadbolt and the associated strike. Also, many prior art paddle handle assemblies have a rather complicated construction, which is expensive to manufacture and difficult to repair. Hence, a paddle handle assembly which overcomes these drawbacks would be advantageous.

SUMMARY OF THE DISCLOSURE

One aspect of the present disclosure is a lock assembly comprises a housing, a handle, and a latch plunger operably connected with the handle. An exterior key lock and interior lock knob have a locked and unlocked position. A lock cam is rotatably and operably connected with the key lock and interior lock knob for rotation therewith. A crank arm of the lock cam is operatively coupled with a deadbolt lock movably mounted in the housing for shifting between a locked position and an unlocked position. The deadbolt lock is also operably coupled with a motor, wherein a motor cam clutch is operably coupled with the motor and operably interposed between the lock cam and the motor, wherein the motor cam clutch allows rotation of the lock cam between the locked and unlocked positions without rotating a motor shaft of the motor.

Another aspect of the present disclosure is a lock assembly adapted for mounting adjacent an associated closure of the type that can be shifted between an open position and a closed position. The lock assembly comprises a housing, an external handle mounted in an exterior portion of the housing for actuation between a first position and a second position, and a latch plunger operably connected with the external handle and configured such that when the external handle is in the first position, the latch plunger is in a latched position, wherein the closure cannot be unintentionally shifted from the closed position, and when the external handle is in the second position, the latch plunger is in an unlatched position, wherein the closure is free to be shifted from the closed position to the open position. A lock cam is rotatably mounted in the housing having a locked and unlocked position, along with a motor. A motor cam clutch is operably coupled with the motor and operably interposed between the lock cam and the motor, and a deadbolt lock is movably mounted in the housing and operatively coupled with each of the lock cam and the motor for shifting between a locked position, wherein the closure is positively retained in the closed position, and an unlocked position, wherein the closure is free to be shifted between the open and closed positions. An input device is operatively connected with the motor, whereby actuation of the input device actuates the motor and contemporaneously shifts the deadbolt lock between the locked and unlocked positions.

Yet a further aspect of the present disclosure is a lock assembly adapted for mounting adjacent an associated closure of the type that can be shifted between an open position and a closed position, the lock assembly comprising a housing, an external handle having a first position and a second position, and a latch plunger operably connected with the external handle and configured such that when the external handle is in the first position, the latch plunger is in a latched position, wherein the closure cannot be unintentionally shifted from the closed position, and when the external handle is in the second position, the latch plunger is in an unlatched position, wherein the closure is free to be shifted from the closed position to the open position. A lock cam is rotatably mounted in the housing having a locked and unlocked position, along with a motor. A motor crank arm is operatively coupled with each of the motor and the lock cam, and a motor cam clutch is operably coupled with the motor and operably interposed between the motor crank arm and the motor. A deadbolt lock is movably mounted in the housing and operatively coupled with each of the lock cam and the motor for shifting between a locked position, wherein the closure is positively retained in the closed position, and an unlocked position, wherein the closure is free to be shifted between the open and closed positions. An input device is operatively connected with the motor, whereby actuation of the input device actuates the motor and contemporaneously shifts the deadbolt lock between the locked and unlocked positions.

Still another aspect of the present disclosure is a lock assembly adapted for mounting on an associated closure and the like of the type that can be moved between an open position and a closed position and an opening in the closure extending between an exterior and an interior surface of the closure. The lock assembly comprises a housing having an exterior housing plate juxtaposed against the exterior surface of the closure and an interior housing plate juxtaposed against the interior surface of the closure, the exterior and interior housing plates attached one to the other between the exterior and interior surface of the closure, a handle pivotally mounted upon the exterior housing plate of the housing for rotation between a retracted position and an extended position, and a latch plunger operably connected with the handle and configured such that when the handle is in the retracted position, the latch plunger is in a latched position, wherein the closure cannot be unintentionally shifted from the closed position, and when the handle is in the extended position, the latch plunger is in an unlatched position, wherein the closure is free to be moved from the closed position to the open position. A key lock is mounted on the exterior housing plate of the housing, where the key lock has a locked and an unlocked position, and a lock cam is rotatably mounted in the housing and operably connected with the key lock for rotation therewith, the lock cam having a crank arm. A link is operably connected with the crank arm of the lock cam, and a deadbolt lock is movably mounted in the housing for shifting between a locked position, wherein the closure is positively retained in the closed position, and an unlocked position, wherein the closure is free to be shifted between the open and closed positions. The deadbolt lock is operably connected with the link. A motor is also operatively connected with the link, and a motor cam clutch is operably coupled with the motor and operably interposed between the lock cam and the motor. An input device is operatively connected with the motor, whereby actuation of the motor shifts the deadbolt lock between the locked and unlocked positions.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
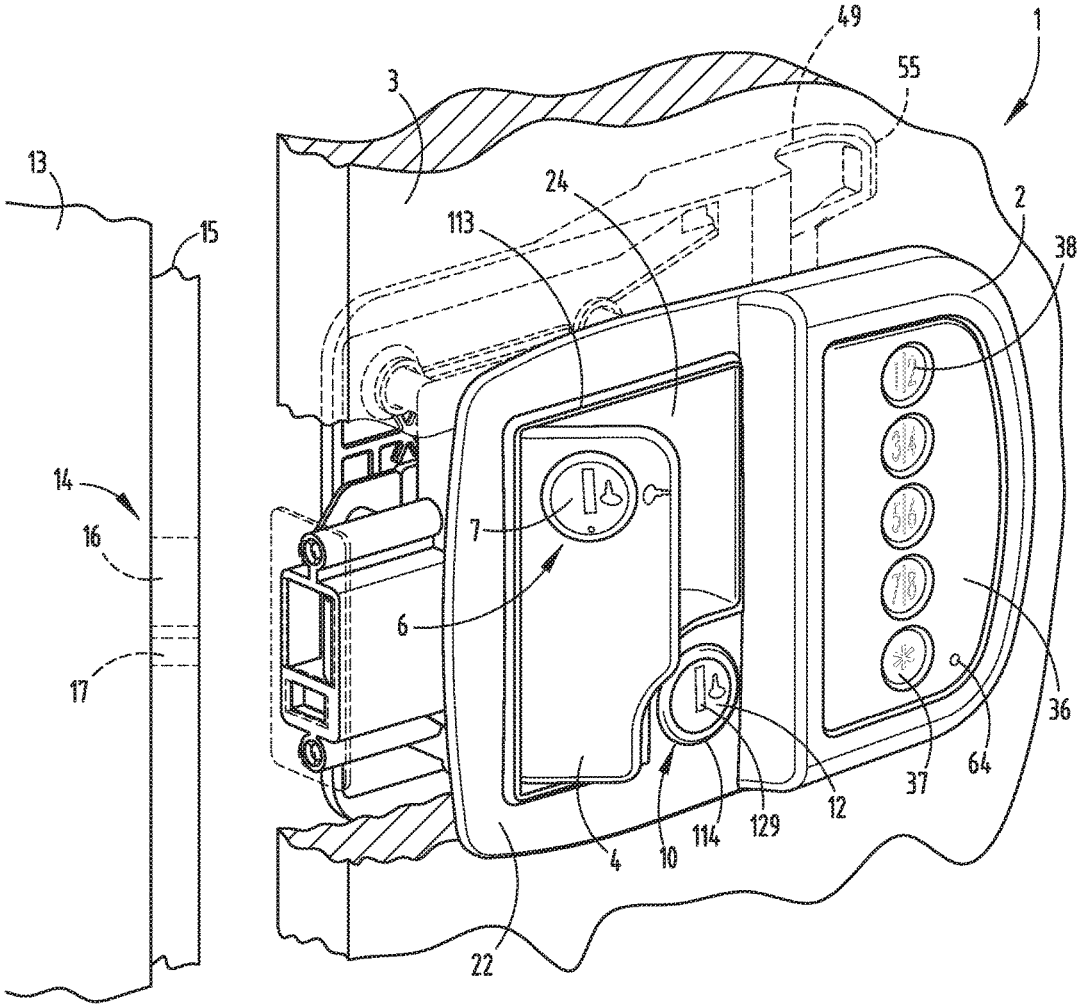
FIG. 1 is a perspective view of a lock assembly embodying the present disclosure, shown mounted in an associated closure.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 18:
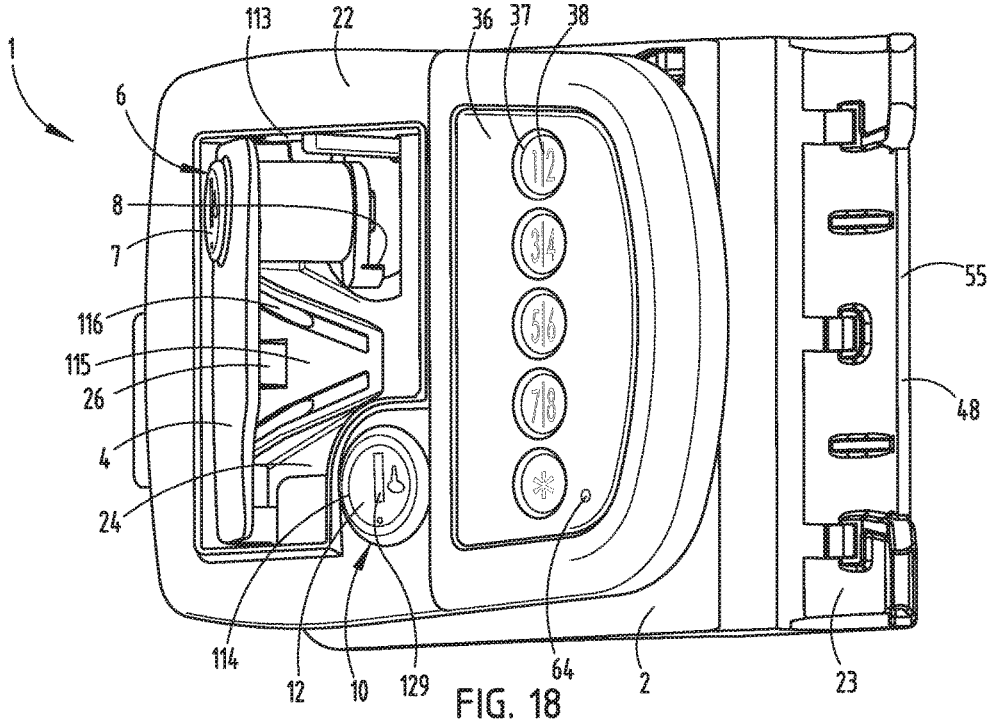
FIG. 18 is an oblique side view of the exterior side of the paddle handle latch assembly, with the paddle handle in the extended position.
Figure 19:
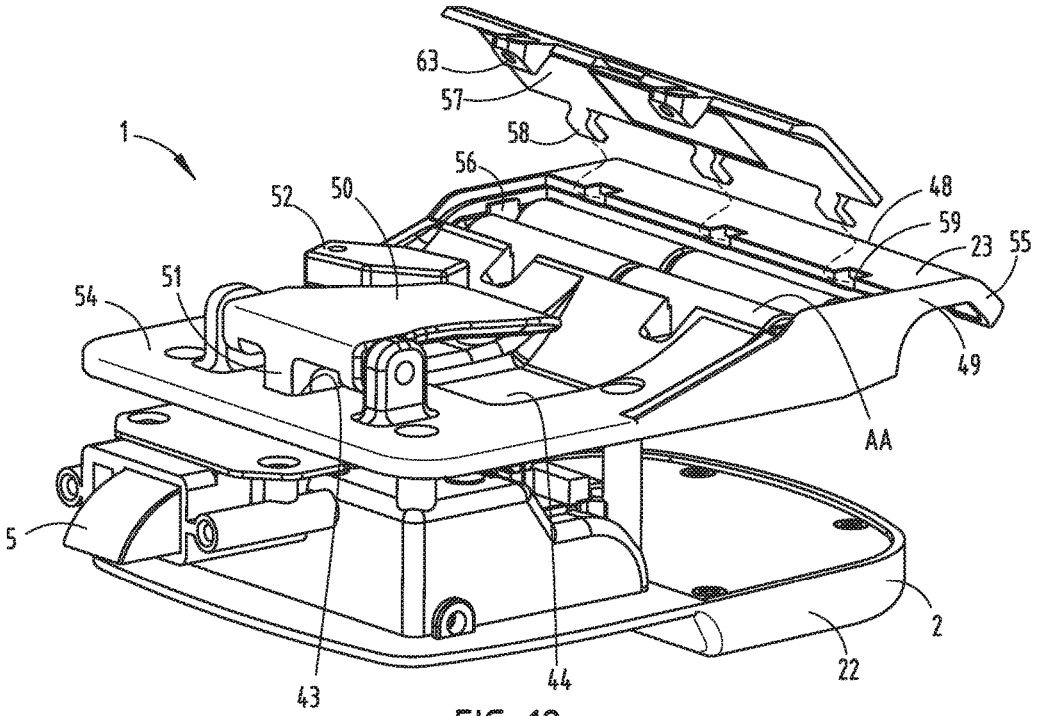
FIG. 19 is a perspective view of the interior side of the lock assembly, shown with the deadbolt lock in the unlocked position.
Figure 19A:
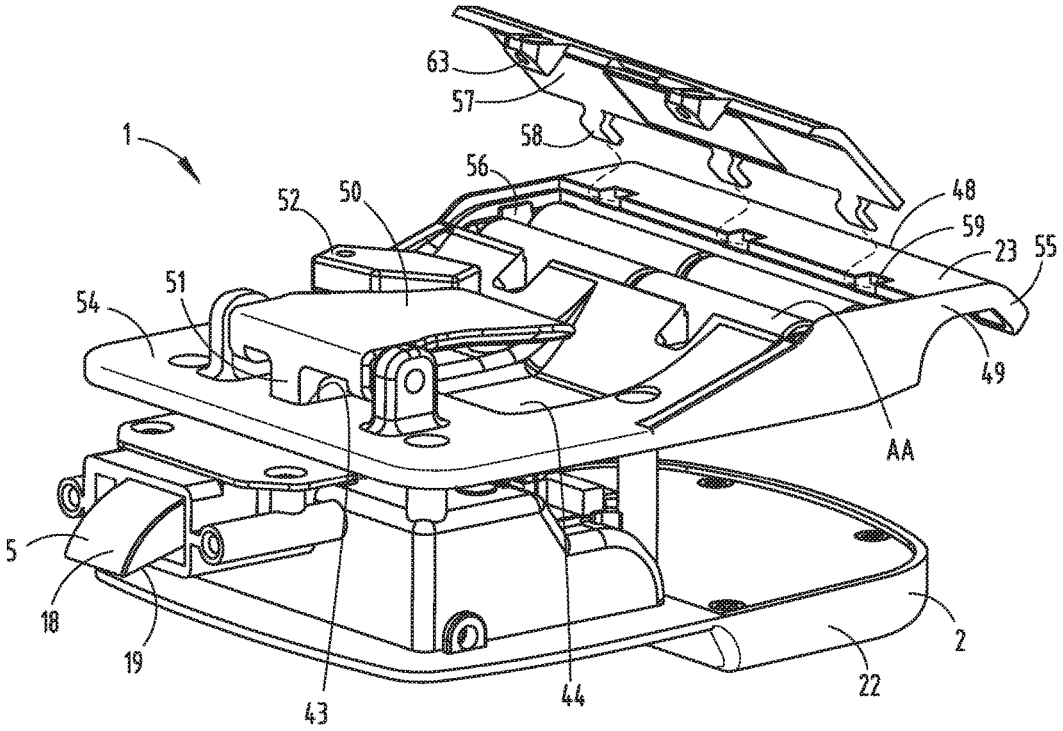
FIG. 19A is a perspective view of the interior side of the lock assembly, shown with the deadbolt lock in the unlocked position.

The reference numeral 1 in the Figures generally designates a lock assembly 1 embodying the present invention. Lock assembly 1 includes a housing 2 adapted for mounting in or adjacent to an associated closure 3 of the type that can be shifted between an open position (FIG. 1) and a closed position. A paddle handle 4 is pivotally mounted in an exterior portion of housing 2 for rotation between a retracted position (FIGS. 6-7) and an extended position (FIGS. 1 and 18). A latch plunger 5 is operably connected with paddle handle 4, and configured such that when paddle handle 4 is in the retracted position, latch plunger 5 is in a latched position (FIGS. 6-7), wherein closure 3 cannot be unintentionally shifted from the closed position, and when paddle handle 4 is in the extended position, latch plunger 5 is in an unlatched position (FIGS. 1 and 18), wherein closure 3 is free to be shifted from the closed position to the open position.

Figure 6:
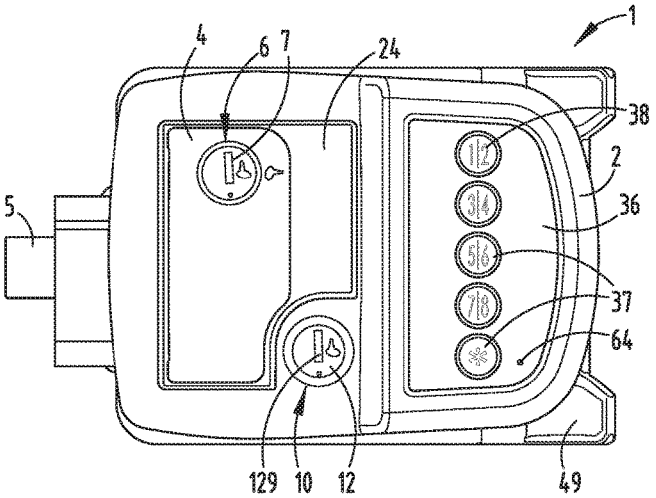
FIG. 6 is a front elevational view of the lock assembly of FIG. 1.
Figure 7:
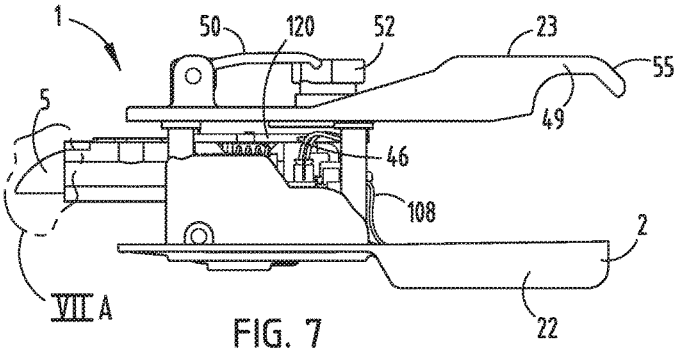
FIG. 7 is a top plan view of the lock assembly of FIG. 1.
Figure 7A:
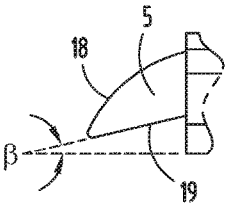
FIG. 7A is top plan view of an embodiment of the latch plunger of the lock assembly of FIG. 1.
Figure 17:
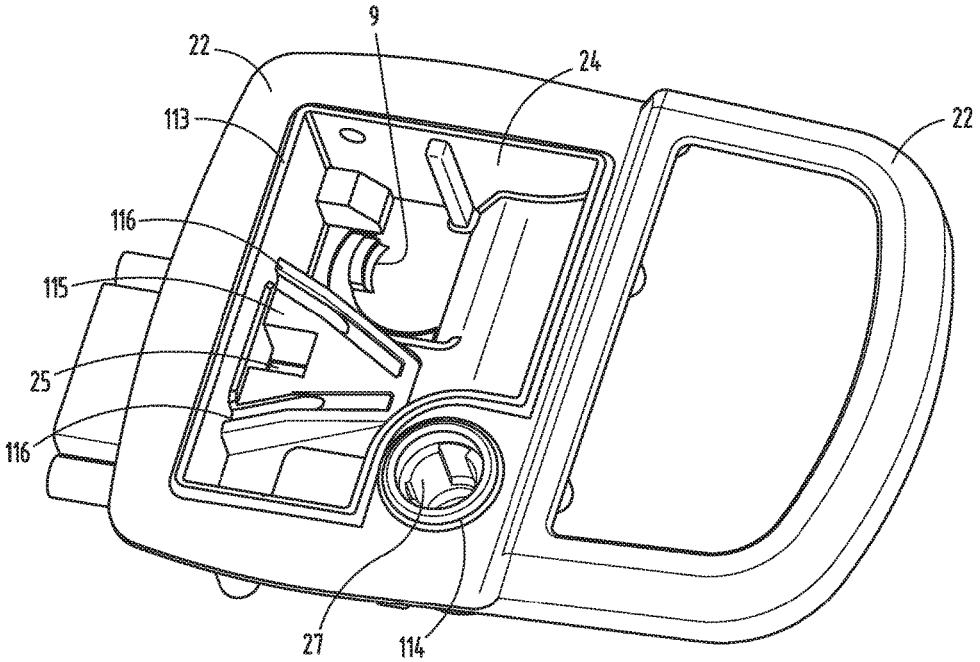
FIG. 17 is a perspective view of the exterior side of the exterior housing plate of the paddle handle latch assembly with the paddle handle removed.

A paddle handle key lock 6 is preferably mounted on the exterior portion of paddle handle 4, and includes a movable key lock member 7 that is selectively movable between a locked position and an unlocked position. A paddle handle lock pawl 8 is movably mounted in paddle handle 4, operably connected with movable key lock member 7, and configured such that when movable key lock member 7 is in the locked position, paddle handle lock pawl 8 engages a paddle handle recess stop 9 (FIG. 17) in which paddle handle 4 is retained in the retracted position (FIGS. 6-7). When movable key lock member 7 is in the unlocked position, paddle handle lock pawl 8 assumes an unlocked position in which paddle handle 4 is free to be shifted between the retracted and the extended positions. The aforementioned locking paddle handle 4 is particularly beneficial for use when the associated vehicle is displayed on a large sales lot or the like, wherein key lock 6 is keyed to accept a master dealer key that can be used to gain interior access to a large number of recreational vehicles for sales purposes.

A deadbolt key lock 10 is mounted in housing 2 for shifting between a locked position (FIG. 3), wherein closure 3 is positively retained in the closed position, and an unlocked position (FIG. 2), wherein closure 3 is free to be shifted between the open and closed positions. Key lock 6 is preferably substantially identical to deadbolt key lock 10. Deadbolt key lock 10 includes a movable deadbolt key lock member 12, such that movement of movable deadbolt key lock member 12 between the locked and unlocked positions contemporaneously shifts deadbolt key lock 10 between the locked and unlocked positions.

In the example illustrated in FIG. 1, the closure 3 in which lock assembly 1 is mounted comprises an entry door for a recreational vehicle, motor home, trailer, shed, or the like, which can be pivotally shifted between open and closed positions along a substantially vertical hinge axis. Closure 3 selectively engages an associated doorframe 13 having a jamb section 14 in which a door strike 15 is mounted. Door strike 15 includes horizontally extending recesses 16, 17 extending into the jamb section 14 into which an associated portion of latch plunger 5 and deadbolt 80 engages and disengages, respectively, to selectively retain closure 3 in the fully closed position, as described in greater detail hereinafter. Of course, recesses 16, 17 can be combined into a single recess.

Figure 4:
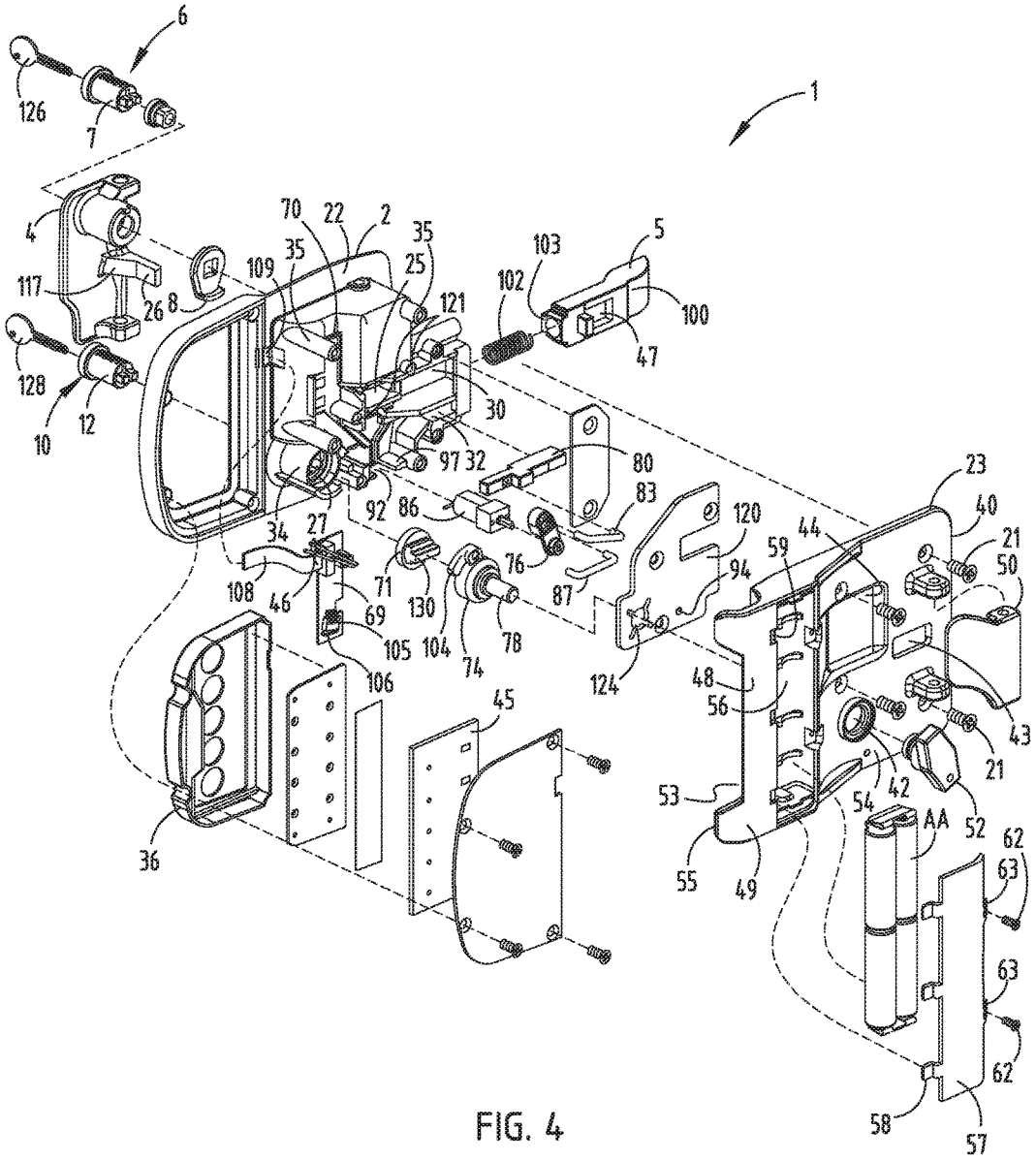
FIG. 4 is an exploded, perspective view of the first embodiment of the lock assembly, taken from an interior side.
Figure 4A:
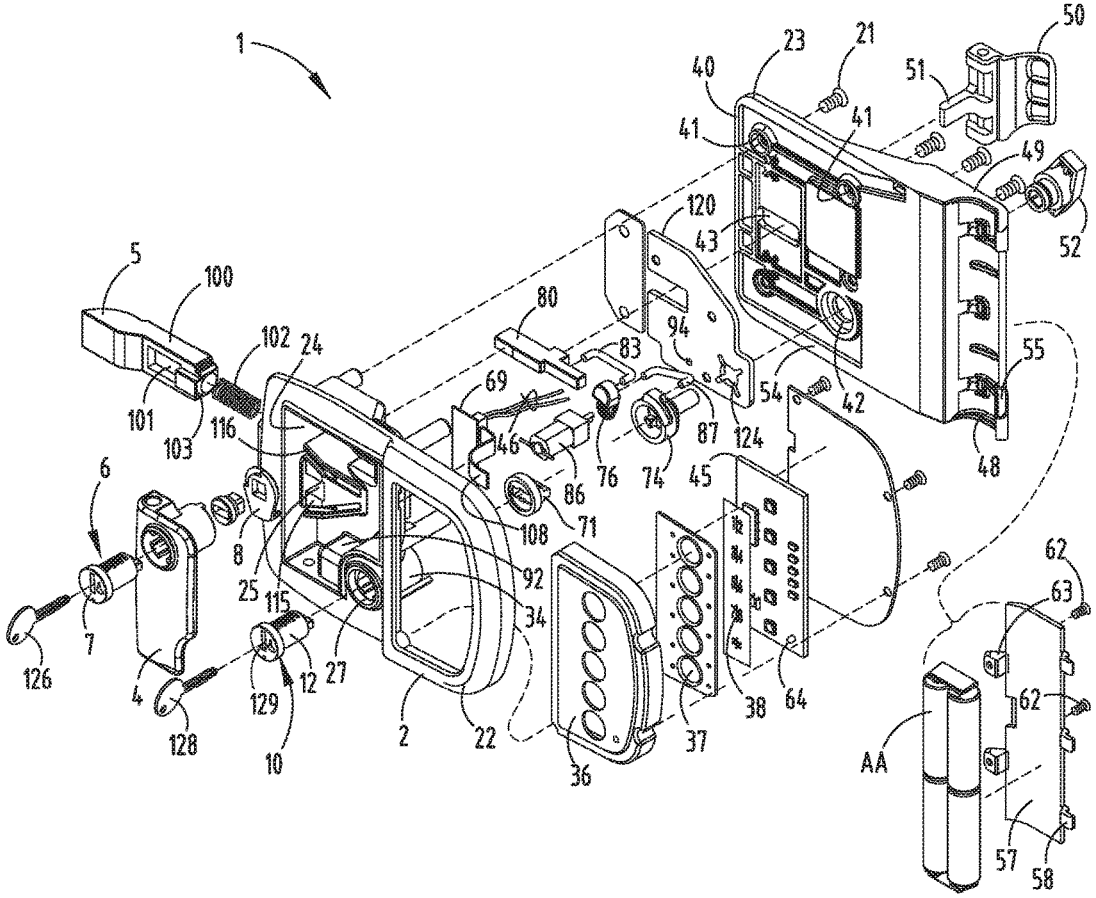
FIG. 4A is an exploded, perspective view of the first embodiment of the lock assembly, taken from an exterior side thereof.
Figure 5:
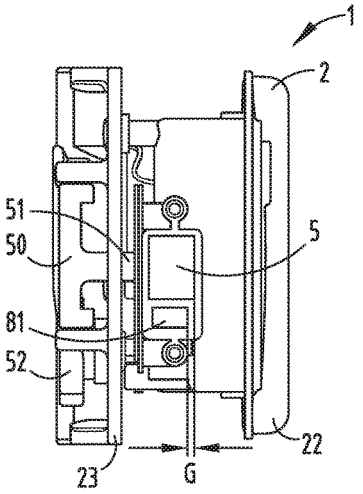
FIG. 5 is a side elevational view of the lock assembly of FIG. 1.

As best illustrated in FIGS. 4-4A, 5, and 7, the housing 2 has a two-part construction, comprising an exterior housing plate 22, in which paddle handle 4 is pivotally mounted, and an interior housing plate 23, which mounts on the interior of closure 3 and is attached to exterior housing plate 22 by fasteners 21. The illustrated exterior housing plate 22 includes a centrally disposed, bowl-shaped paddle handle recess 24 located directly behind paddle handle 4, which provides finger access to facilitate rotation of paddle handle 4 between the retracted and extended positions. The bottom wall of paddle handle recess 24 includes an actuator window 25 through which an actuator tab 26 on paddle handle 4 extends to operate latch plunger 5, as described in greater detail hereinafter, and also includes on a marginal portion the paddle handle recess 24, described above. The marginal portion of exterior housing plate 22 includes a lock aperture 27 in which deadbolt key lock 10 is mounted. A computer input device, such as touch pad 36 containing a plurality of buttons 37, each preferably having numerical indicia 38 thereon, as best shown in FIGS. 1 and 4A, is located on the exterior of the exterior housing plate 22 and can be used to actuate the lock assembly 1, as more fully described below.

Figure 2:
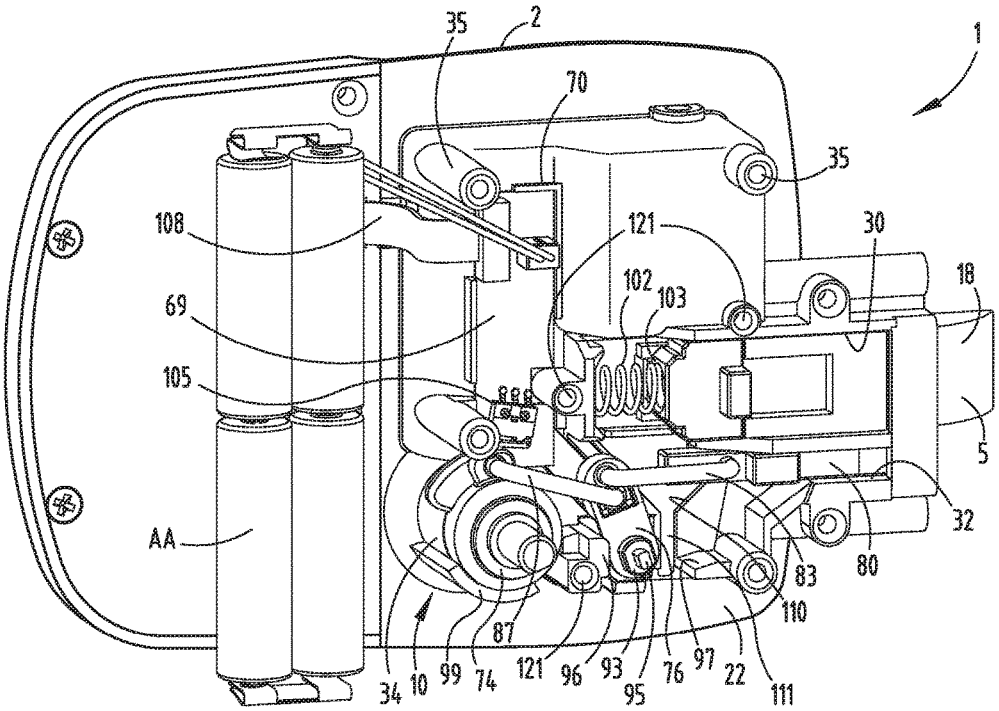
FIG. 2 is a perspective view of a first embodiment of an interior portion of the exterior housing plate of the lock assembly, shown with a latch plunger portion in a latched position, and deadbolt lock portions thereof in an unlocked position.
Figure 2A:
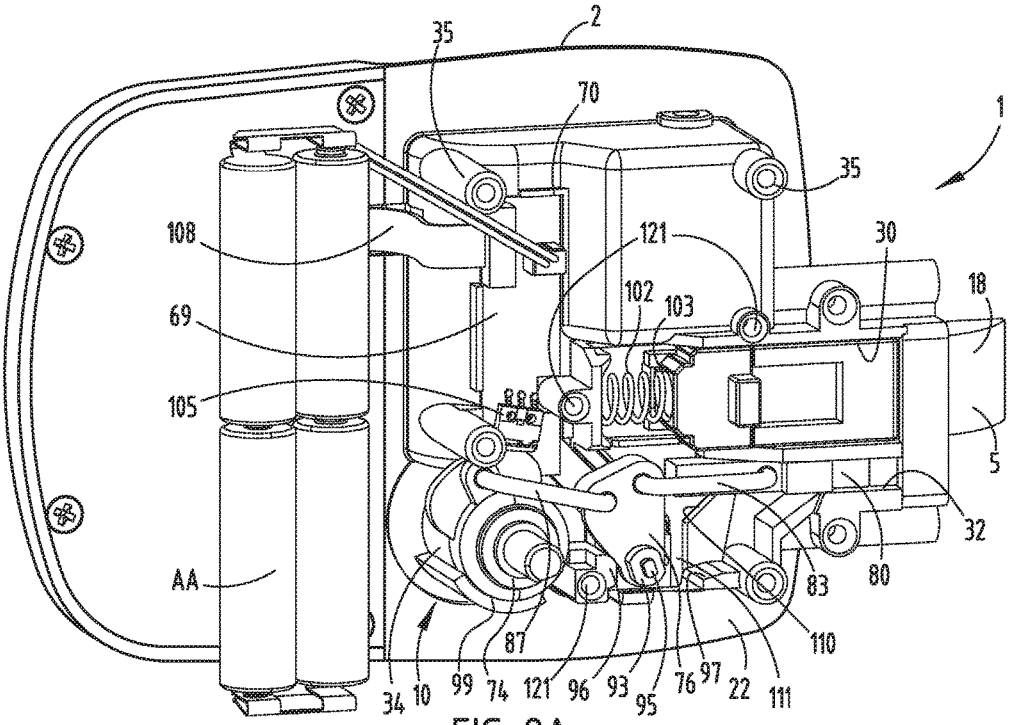
FIG. 2A is a perspective view of the first embodiment of the interior portion of the exterior housing plate of the lock assembly, shown with a latch plunger portion in a latched position, and deadbolt lock portions thereof in an unlocked position and an alternative embodiment of the motor crank arm.
Figure 3:
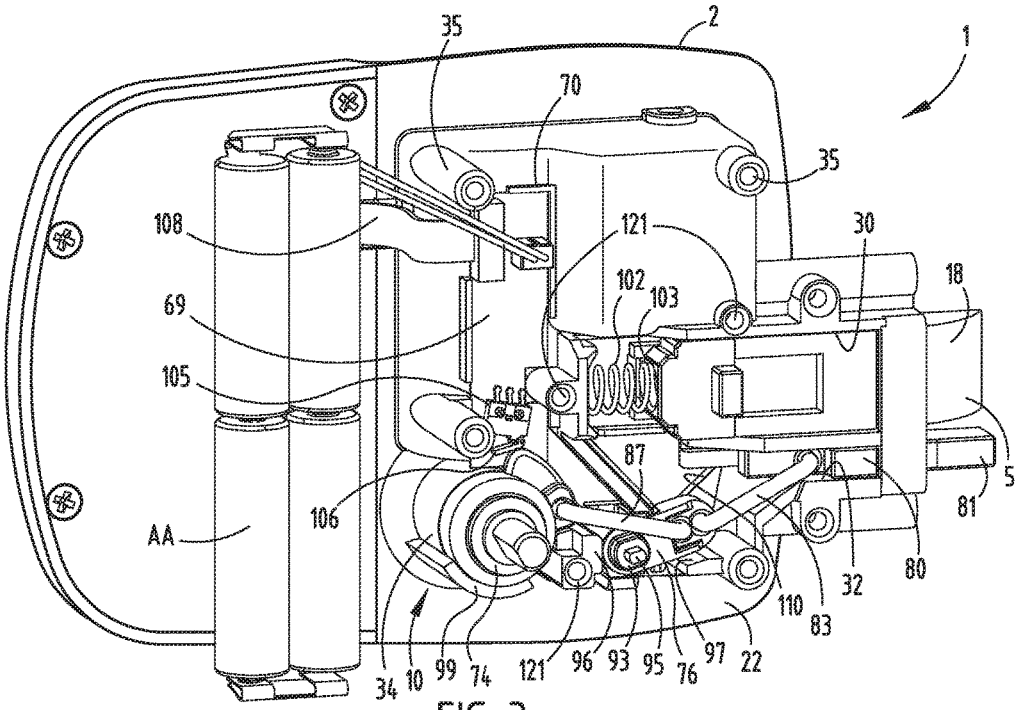
FIG. 3 is a perspective view of the first embodiment of the interior portion of the exterior housing plate of the lock assembly, shown with the latch plunger in a latched position, and deadbolt lock in a locked position.
Figure 3A:
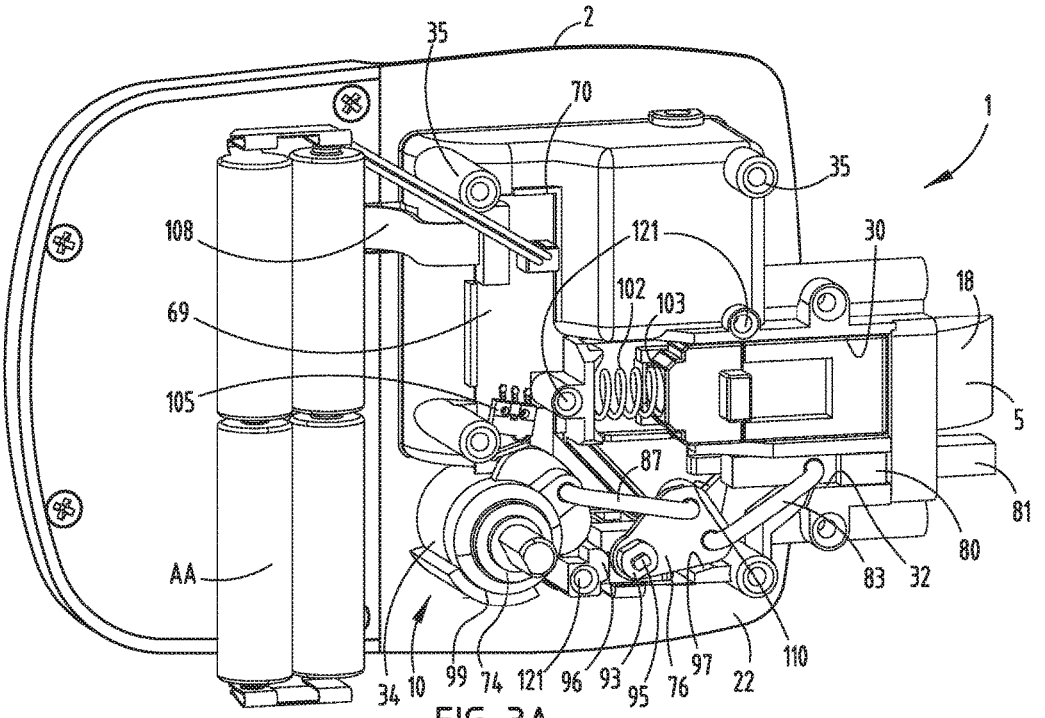
FIG. 3A is a perspective view of the interior portion of the first embodiment of the exterior housing plate of the lock assembly, shown with the latch plunger in a latched position, and deadbolt lock in a locked position and an alternative embodiment of the motor crank arm.

As best illustrated in FIGS. 2-4, the inside surface of exterior housing plate 22 includes a centrally disposed, horizontally extending latch plunger slide channel 30 and a horizontally extending deadbolt lock slide channel 32 disposed vertically below latch plunger slide channel 30 for mounting therein associated portions of lock assembly 1, as described in greater detail hereinafter. The inside surface of the exterior housing plate 22 also includes a cylindrically shaped lock boss 34, the interior of which defines lock aperture 27, and a plurality of rearwardly projecting fastener bosses 35, which facilitate connection of interior housing plate 23 to exterior housing plate 22 using fasteners 21. The inside surface of the exterior housing plate 22 also includes a microchip or controller 45 and motor 86, as further described below.

Figure 8:
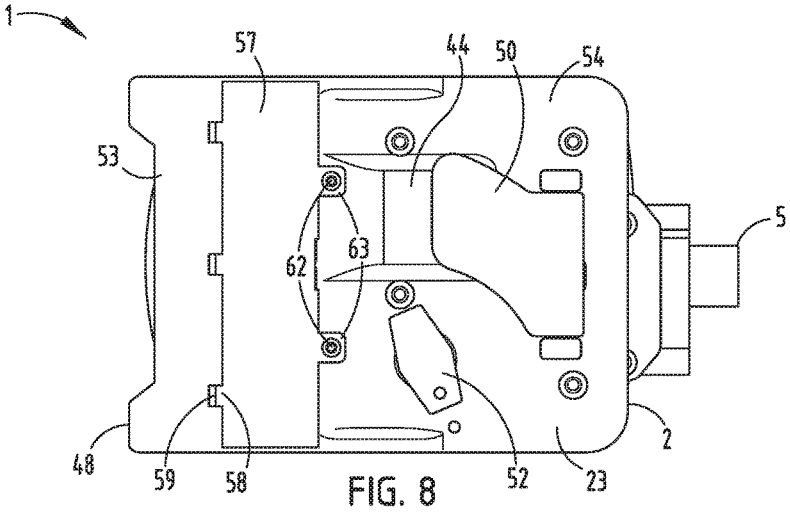
FIG. 8 is a rear elevational view of the lock assembly of FIG. 1.

The interior housing plate 23 (FIGS. 4-4A and 8) of housing 2 includes a marginal portion 40 which engages the interior surface of closure 3, as well as fastener bosses 41, a lock boss 42, a centrally disposed actuator window 43, and a finger recess 44. The rearwardmost or interior side edge 48 of interior housing plate 23 is contoured inwardly to define a stationary interior handle 49, which facilitates opening and closing closure 3 from the interior portion of the vehicle. A release lever 50 is pivotally mounted on the inner surface of interior housing plate 23 and extends generally over finger recess 44. Release lever 50 includes a protruding actuator tab 51, which extends through actuator window 43 in interior housing plate 23 and into an interior pocket 47 in the slide portion 100 of latch plunger 5 to selectively shift the same to the unlatched position, as described in greater detail below. An interior lock knob 52 is pivotally received in lock boss 42 on interior housing plate 23 and is operably connected with the movable key lock member 12 of deadbolt key lock 10 to lock and unlock deadbolt 80, as described below.

As best illustrated in FIGS. 4 and 7, interior handle 49 is formed integrally with interior housing plate 23 along a rearwardmost interior side edge 48 thereof, and includes a central cutaway area 53 for finger access to facilitate shifting closure 3 between the open and closed positions. Interior handle 49 has a flat portion 54 disposed substantially coplanar with the innermost surfaces of release lever 50 and lock knob 52. Furthermore, interior handle 49 includes a downwardly angled exterior portion 55 in which cutaway area 53 is formed, and is disposed in an inwardly angled orientation with respect to flat portion 54. The ramp-shaped exterior portion 55 of interior handle 49 deflects or leads a pleated or sliding screen over the interior of lock assembly 1, so as to avoid interference. The finger recess 44 achieves a low profile, while facilitating grasping and rotating interior release lever 50.

The interior housing plate 23 is also provided with a battery compartment 56 disposed between the interior handle 49 and the interior lock knob 52 and release lever 50. The battery compartment 56 is preferably adapted to receive four AA batteries, which are common and easy to install. A battery compartment cover 57 is removably attached to the interior housing plate 23 through tabs 58 that are received within recesses 59 on one edge of the battery compartment 56 and fasteners 62 that secure attachment tabs 63 to the opposite edge of the battery compartment 56. The batteries in the battery compartment 56 in the interior housing plate 23 are electrically coupled through power lines 46 to provide electrical power to the controller 45 and motor 86 mounted on the exterior housing plate 22, as described below.

Figure 11:
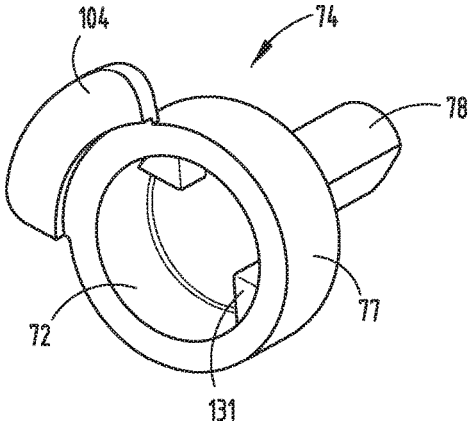
FIG. 11 is an enlarged, perspective view of a first embodiment of the lock cam of the lock assembly, taken from an exterior side thereof.
Figure 12:
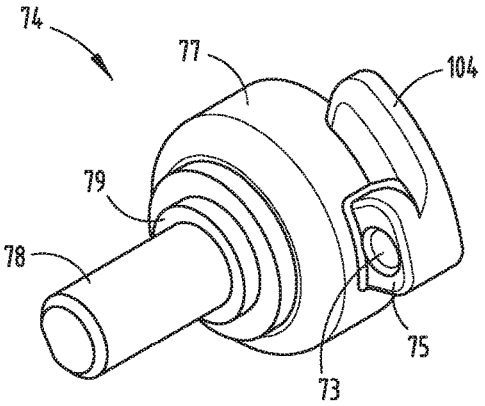
FIG. 12 is an enlarged, perspective view of the lock cam, taken from an interior side thereof.
Figure 12A:
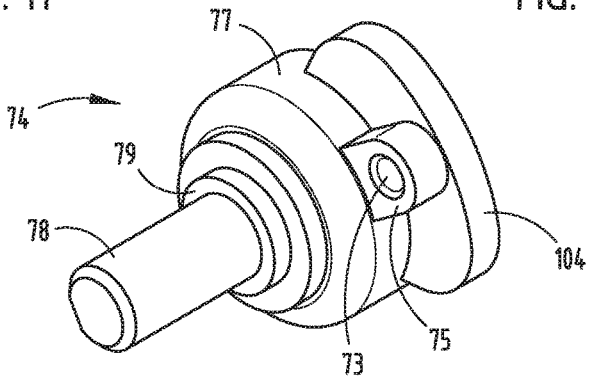
FIG. 12A is an enlarged, perspective view of an alternative embodiment of the lock cam.
Figure 13:
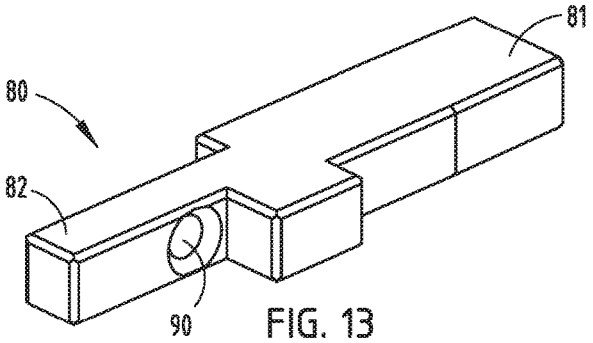
FIG. 13 is an enlarged, perspective view of the deadbolt.

In the illustrated example, the movable deadlock key lock member 12 of deadbolt key lock 10 is received in the lock aperture 27 on the exterior housing plate 22, and is rotatably mounted in lock boss 34 for rotation between locked and unlocked positions. The illustrated lock cam 74, best shown in FIGS. 11-12, has a crank arm 75 that is operably connected with deadbolt key lock 10, as described below. Lock cam 74 has a cylindrically shaped base 77 with a recessed end 72 oriented toward exterior housing plate 22, a stop or collar 79, and a faced shaft 78 oriented toward interior housing plate 23. A cam actuator 71 is fitted within the recessed end 72 and is coupled to the distal end of deadbolt key lock member 12. The recessed end 72 of lock cam 74 is preferably provided with opposed lobes 131 on its interior surface. The face of cam actuator 71 facing the recessed end 72 is preferably provided with a center edge 130. This structure allows the rotation of the deadbolt key lock member 12 and cam actuator 71 within the recessed end 72 to rotate the lock cam 74, but likewise allows the lock cam 74 to rotate to a degree independent of and without the necessity of rotation of the deadbolt key lock member 12 and cam actuator 71, as discussed below.

The base 77 of the lock cam 74 is received within the lock boss 34 and engages a recess 98 to positively position the lock cam 74 for rotation about its axis only. Also, a lock cam support 99 is provided at the marginal edge of the lock boss 34 to further restrain the lock cam 74 from extraneous motion. The faced shaft 78 on lock cam 74 extends through the lock boss 42 in the interior housing plate 23, and engages lock knob 52 mounted on the interior end thereof, such that rotation of lock knob 52 from the interior of the closure rotates lock cam 74 between the locked and unlocked positions to shift the deadbolt 80 between the locked and unlocked positions, as described below.

With reference to FIGS. 2, 3, 4, 4A, 9, and 10, the illustrated deadbolt key lock 10 and lock knob 52 are operably connected with the deadbolt 80 slidably mounted in the deadbolt lock slide channel 32 of exterior housing plate 22, which includes an outer end 81 that extends exterior of housing 2 for engagement with door strike 15, and an inner end 82, which extends interior of housing 2. A first link 83 has a first end 84 thereof pivotally connected with an orifice 90 provided at the inner end 82 of deadbolt 80, and a second end 85 thereof pivotally connected with a first orifice 60 in a motor crank arm 76, which is, in turn, operably connected to motor shaft 95 extending from motor 86 mounted to the exterior housing plate 22.

A second link 87 has a first end 88 thereof pivotally connected with a second orifice 61 in the motor crank arm 76 and a second end 89 thereof pivotally connected to orifice 73 of crank arm 75 of the lock cam 74, such that rotation of motor shaft 95 rotates motor crank arm 76 between the locked and unlocked positions and simultaneously longitudinally shifts the deadbolt 80 between the locked and unlocked positions. Preferably, the first link 83 and the second link 87 are identical in length, height, gage, and material so as to be interchangeable, preventing assembly error. Preferably, the motor 86 is a 6 vdc motor capable of 320-340 RPM at 6 vdc with a gear reduction of 100:1, which, due to the geometry of the linkages and along with the fact that with two separate linkages the motor 86 need only rotate 90 degrees or less, preferably less than about 80 degrees, and provides high-speed actuation capable of activating deadbolt 80 in approximately ¼ second.

With reference to FIGS. 2A, 3A, 4, 4A, 9A, and 10A, an alternative embodiment is disclosed, wherein a distal end 91 of the motor crank arm 76 has a generally trapezoidal shape to which the second end 85 of the first link 83 is received in first orifice 60 and the first end 88 of the second link 87 is received in second orifice 61. As best shown in FIGS. 2A, 3A, 9A, 10A, and 12A, in the present disclosed embodiment, the second end 89 of the second link 87 is mounted approximately on the midway of a sensor cam 104 (discussed further below) so as to apply a generally tangential load to the lock cam 74 throughout the operative rotation of the lock cam 74 between the unlocked and locked positions shown in FIGS. 9A and 10A. It has been found that when the second end 89 of the second link 87 is mounted on an end of the sensor cam 104 closer to the deadbolt 80 than midway, as shown in the embodiment depicted in FIGS. 2, 3, 9, and 10, the load on the lock cam 74 from the second link 87 is directed more toward the center of rotation of the lock cam 74 when moved from the locked to the unlocked position, which tended to add undesired stress to the gears of the motor 86. By disposing the first orifice 60 on the distal end 91 of the motor crank arm 76 in closer proximity to deadbolt 80, in both the unlocked and locked positions, than the second orifice 61, the second orifice 61 and first end 88 of the second link 87 can be raised relative the distal end 91 of the motor crank arm 76 in both the unlocked and locked positions to provide a generally tangential load to the lock cam 74.

Figure 16:
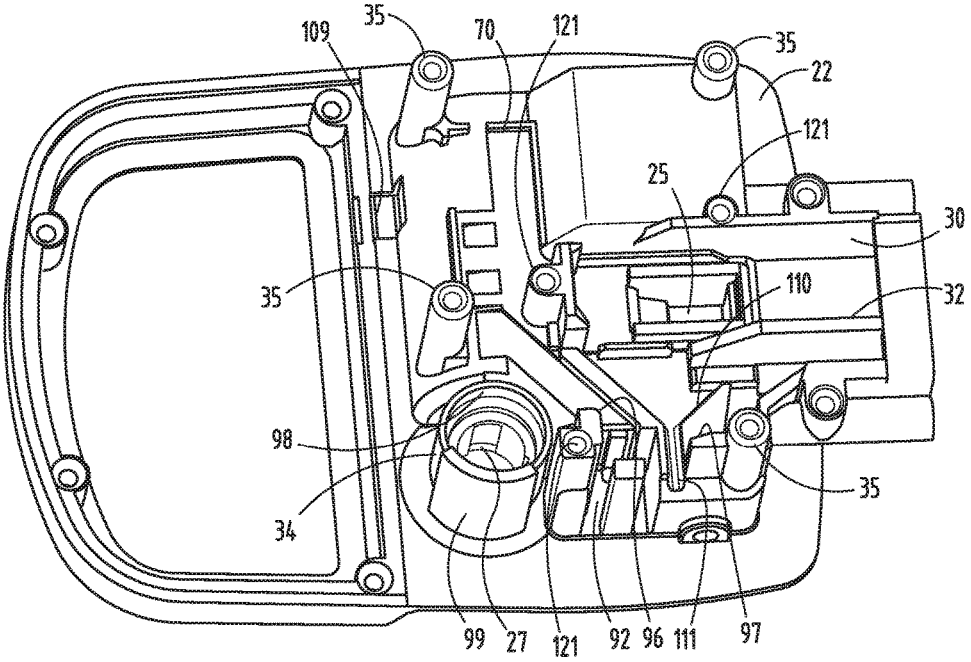
FIG. 16 is a perspective view of the interior side of the exterior housing plate of the paddle handle latch assembly.

The motor 86 is preferably mounted in a recess pocket 92 integrally molded into the interior side of the exterior housing plate 22. As best shown in FIG. 16, the pocket 92 is designed to prevent water pooling proximate the motor 86, as further described below. The pocket 92 securely contains the motor 86 from misalignment and provides ease of assembly because the motor 86 is simply slid into the pocket 92. An interconnect board 69, into which the battery power line 46 is connected via a plug, provides power to the touch pad 36 and the motor 86 via wires 108 routed through wire channel 109. The interconnect board 69 also contains one or more micro switches 105, discussed below, for indicating the locked and unlocked deadbolt 80 positions. Preferably, the interior surface of the exterior housing plate 22 incorporates a pocket 70 for ease of location and installation of interconnect board 69.

In the illustrated lock assembly 1, the interior backer plate 120 is disposed between the exterior and interior housing plates 22 and 23, covers the interior faces of deadbolt 80 and slide portion 100, and is attached to fastener bosses 121 on the interior side of exterior housing plate 22 to retain the moving components securely in place.

It is desirable to maintain the motor crank arm 76 in position to prevent a false indication given from the micro switch 105, as discussed below. In other words, it is preferred that the motor crank arm 76 rotates about a fixed axis. The axis of rotation of the motor crank arm 76 is fixed by a combination of a pocket 92, discussed above, as well as a circular pad 93 on the motor crank arm 76 and an orifice 94 in the interior backing plate 120 that holds the motor 86 in place. These features prevent the motor crank arm 76 from moving laterally, and yet allow the motor crank arm 76 to freely rotate. Preferably, the interior surface of the exterior housing plate 22 includes physical stops 96, 97 to prevent the motor crank arm 76 from over rotation and to prevent the deadbolt 80 from being forced to the unlocked position. As for the lock cam 74, it is likewise preferred to keep the lock cam 74 and sensor cam 104 rotating about a fixed axis. Thus, faced shaft 78 extending beyond stop or collar 79 is therefore preferably sized to extend into recess 124 axially positioned on the interior backing plate 120, so as to prevent the axis of lock cam 74 from moving vertically or horizontally and in rotation only.

The illustrated latch plunger 5 includes a slide portion 100 which is slidably mounted in the latch plunger slide channel 30 on the inside surface of exterior housing plate 22 for laterally shifting between latched and unlatched positions. Slide portion 100 has an exterior pocket 101 into which the actuator tab 26 on paddle handle 4 is received, such that shifting paddle handle 4 from the exterior of the vehicle between the retracted and extended positions longitudinally shifts slide portion 100 in a lateral direction between the latched position shown in FIG. 2 and the unlatched position shown in FIG. 1. Slide portion 100 has an interior pocket 47 into which the actuator tab 51 on release lever 50 is received, such that shifting release lever 50 from the interior of the closure similarly shifts slide portion 100 between the latched and unlatched positions. A coil spring 102 is mounted in the latch plunger slide channel 30 and is abuttingly received in a centering hole 107 in the rearward side edge 103 of slide portion 100 to urge slide portion 100 toward the normally latched position shown in FIGS. 2 and 3.

In operation, closure 3 can be shifted from the closed to the open position from the exterior of the vehicle in the following manner. With the paddle handle 4 in the unlocked position via key 126 and the deadbolt key lock 10 in the unlocked position, paddle handle 4 may be rotated outwardly from the retracted position to the extended position. Rotation of paddle handle 4 from the retracted position to the extended position pivots actuator tab 26 laterally, which, in turn, moves slide portion 100 laterally inwardly. The lateral inward shifting of slide portion 100 causes the latch plunger 5 to shift to the unlatched position. The latch plunger 5 thereby disengages from the door strike recess 16, and permits the user to shift closure 3 from the closed position to the open position, as shown in FIG. 1.

Closure 3 can be similarly shifted from the closed position to the open position from the interior of the closure in the following manner. With the paddle handle 4 in either of the locked or unlocked positions and the deadbolt key lock 10 in the unlocked position, release lever 50 may be rotated laterally inwardly from the retracted position to the extended position, which pivots actuator tab 51 laterally, and moves slide portion 100 inwardly. The inward shifting of slide portion 100 also causes the latch plunger 5 to shift to the unlatched position. The latch plunger 5 thereby disengages from the door strike recess 16, and permits the user to shift closure 3 from the closed position to the open position, as shown in FIG. 1.

In order to return the closure 3 to the closed and latched position from either the exterior or interior of the closure, the user simply shifts closure 3 to the closed position, which causes an inclined surface 18 on latch plunger 5 to strike the door strike 15 and thereby push latch plunger 5 into the interior of the lock assembly 1. When the latch plunger 5 comes into registry with the door strike recess 16, the latch plunger 5 is urged back to the latched position by virtue of the spring biasing force exerted by coil spring 102, thereby preventing the door from being inadvertently shifted from the closed position to the open position. Preferably, the latch plunger 5 also has a slightly inclined surface 19 relative its longitudinal length that replaces the normally flat surface opposite the inclined surface 18, as indicated by angle β shown in FIGS. 7A, 15A, 15B, and 19A. It has been found that such an inclined surface 19, which preferably extends outwardly toward the exterior of the housing at about 4 degrees relative the longitudinal length of the latch plunger 5, provides a greater resistance to inadvertent opening of the closure 3 and more reliable engagement with the door strike recess 16, particularly when the lock assembly 1 is applied to a trailer or other mobile application subject to significant vibrations during transit.

When the closure 3 is in the fully closed and latched position, the same can be positively locked in place by rotation of deadbolt key lock member 12 or interior lock knob 52. More specifically, a matching deadbolt key 128 is inserted into the key slot 129 in deadbolt key lock member 12, and the same are then rotated from the unlocked position to the locked position. Rotation of deadbolt key lock member 12 rotates lock cam 74, which, in turn, contemporaneously shifts the crank arm 75 of lock cam 74, second link 87 pivotally connected with motor crank arm 76, motor crank arm 76, first link 83 pivotally connected with motor crank arm 76 and the inner end 82 of deadbolt 80, and deadbolt 80 from the unlocked to the locked position. In the locked position, deadbolt 80 engages door strike recess 17 in the door strike 15, and positively prevents opening of the door. The deadbolt key lock 10 is unlocked by rotating deadbolt key 128 and associated deadbolt key lock member 12 in the opposite direction. The deadbolt 80 can be similarly shifted between the locked and unlocked positions from the interior of the closure 3 by rotation of interior lock knob 52.

The closure 3 can also be positively locked in place by actuation of touch pad 36. In practice, a numerical code is programmed on the microchip or controller 45 at the time of manufacture of the lock assembly 1. Preferably, the original code is a null-code, such as "1111." After purchase by the end-user, the code can be modified and customized to the end-user's preference. Preferably, the code may be repeatedly changed as deemed appropriate by the end-user. Once the predetermined numerical code is entered into the buttons 37 of touch pad 36, the controller 45 receives a signal that the closure 3 is to be placed in the locked mode. The controller 45 then opens a switch to send electrical power to actuate the lock motor 86. Preferably, the rotation of the motor 86 is about 90 degrees or less, and more preferably less than 80 degrees, in either direction. From the perspective shown in FIGS. 2, 2A, 3, 3A, 10, and 10A, upon actuation of the lock motor 86, the lock motor 86 rotates the motor crank arm 76 clockwise, which shifts the first link 83 pivotally connected with motor crank arm 76 and the inner end 82 of deadbolt 80, and deadbolt 80 from the unlocked to the locked position. In the locked position, deadbolt 80 engages door strike recess 17 in the door strike 15, and positively prevents opening of the door. The crank arm 75 of lock cam 74 and second link 87, pivotally connected with motor crank arm 76, are also placed in the locked position. The deadbolt 80 is unlocked by re-entry of the predetermined numerical code and subsequent rotation of the lock motor 86 counterclockwise.

The controller 45 is a standard printed circuit board, as is known in the art. Moreover, in addition to actuating the deadbolt 80 as described above, the controller 45 is useful in other tasks, such as monitoring the state of battery charge. In particular, the controller 45 can be programmed to activate a warning indicator, such as a blinking illuminator behind the buttons 37 upon entry of the code or a light emitting diode (LED) telltale (not shown), upon the battery charge dropping below a predetermined level, advising the end-user that the batteries should be replaced.

However, in the event of an electrical problem with the lock assembly 1, the deadbolt 80 can still be activated by the deadbolt key 128 or internal lock knob 52. That is, the deadbolt 80 can be similarly shifted between the locked and unlocked positions from the interior of the closure by rotation of interior lock knob 52 and from the exterior of the closure by rotation of the deadbolt key lock member 12.

Figure 14:
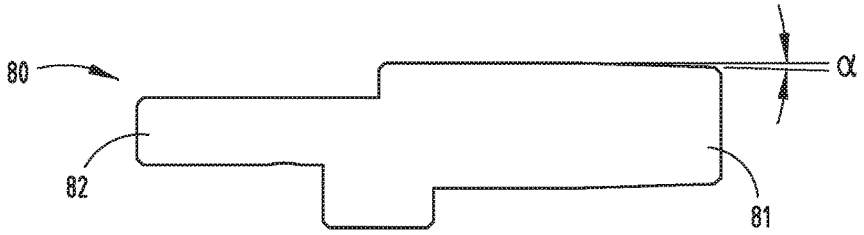
FIG. 14 is an enlarged, elevational view of the deadbolt.
Figure 15:
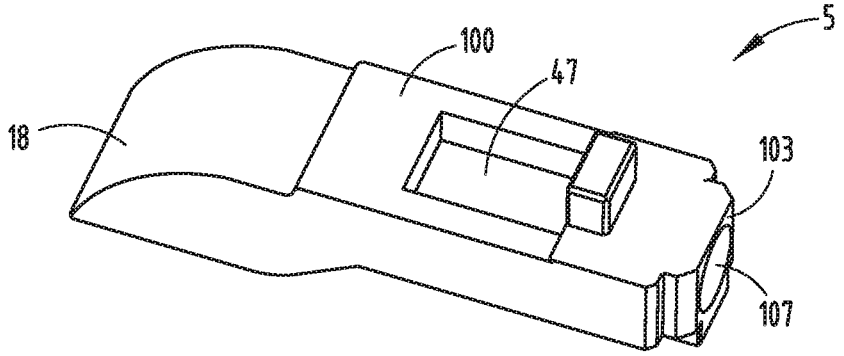
FIG. 15 is an enlarged, perspective view of the latch lock.
Figure 15A:
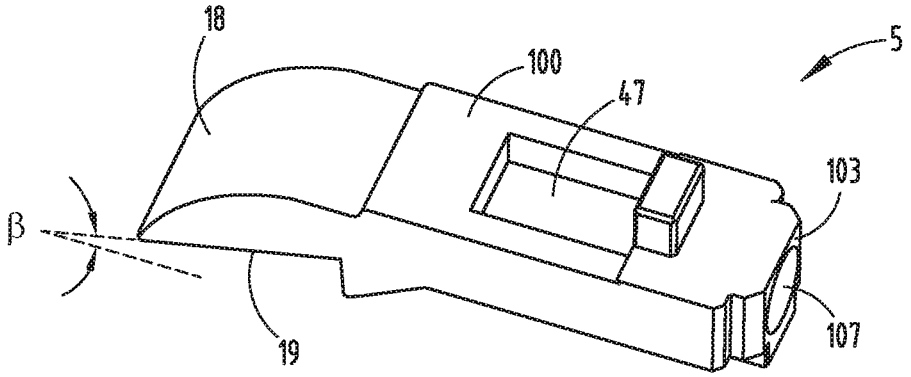
FIG. 15A is an enlarged, perspective view of an alternative embodiment of the latch lock.
Figure 15B:
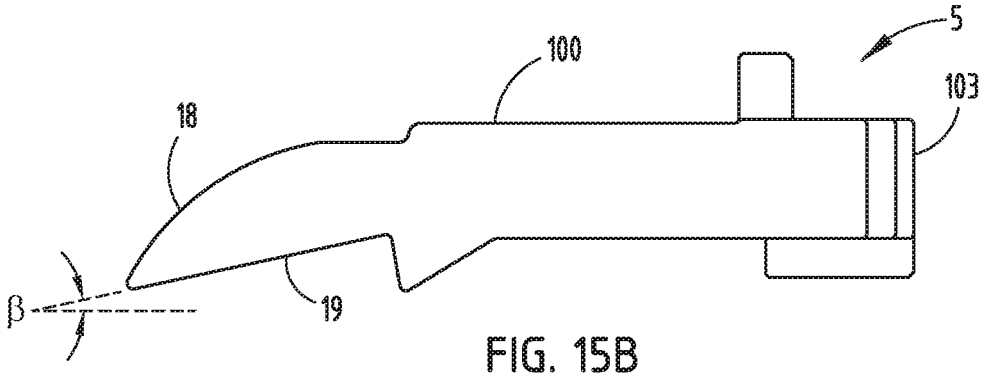
FIG. 15B is an enlarged, side view of an alternative embodiment of the latch lock of FIG. 15A.

Preferably, the deadbolt outer end 81 is slightly tapered toward its distal end, as indicated by angle α shown in FIG. 14. Also, the deadbolt end 81 is preferably narrower than the latch plunger 5 in cross-sectional lateral thickness, as indicated by gap G shown in FIG. 5. That is, with the latch plunger 5 engaged into the door strike recess 16, it should be impossible for the deadbolt outer end 81 to be obstructed from its insertion into the door strike recess 17, assuming the door strike recess 17 has the same lateral width as the door strike recess 16. This prevents misalignment and reduces drag for the motor 86. This is an important feature because closures 3 may be installed out of square or the hinges may sag, making activation of the deadbolt 80 difficult. For proper operation and long life, there must be little resistance to the electric motor. Therefore, eliminating any possible interference for the deadbolt 80 is highly desirable. For similar reasons, the contact surface area between the deadbolt 80 and deadbolt lock slide channel 32 in the housing 2 should be minimized to reduce friction as much as possible.

In the preferred example, a computer input device in the form of a flat panel or surface divided into several, differently marked, touch-sensitive areas form a relatively large, illuminated touch pad 36 comprising buttons 37. Preferably, the touch pad 36 is provided by HSS Touch Technology and developed by AlSentis® HSS™, which is capable of identifying when a surface touch occurs without using predetermined capacitive thresholds. This technology has been found to inherently overcome system variance, such as changes in manufacturing tolerance. Moreover, such touch systems can be implemented more quickly, with more reliability and in more challenging environments, particularly in the presence of moisture and contaminants. Further, such systems consume only half the power of more traditional capacitive touch technologies, which prolongs battery life. However, more traditional capacitive touch technologies and mechanical buttons can be beneficially employed as the buttons 37 of the touch pad 36. Preferably, the buttons 37 have a diameter of at least ½ inch, with black numerical indicia 38 against a white background. Other indicia can be used, such as letters and symbols. Also, a sensor 64 is disposed on the controller 45 and extends to the external surface of the exterior housing plate 22 for determining the proximity of a hand of a user. Illuminators that illuminate the buttons 37 of the touch pad 36, such as LEDs, are disposed beneath the buttons 37, which are preferably translucent. Upon detection of the user's hand, the controller 45 activates the LEDs to backlight the numerical indicia 38 to facilitate entry of the code. After a predetermined period of non-use, the LEDs are deactivated to conserve battery power. Alternatively, and preferably, the illuminators are actuated by touch or depression of any of the buttons 37, as is readily available using the HSS Touch Technology.

Additionally, audible feedback may be provided to successfully indicate locking and unlocking functions. For example, audible features may also be used to: signal that the assembly is ready to accept new code by emitting three short beeps; signal that a new code is entered by emitting four short beeps; signal that an incorrect code was entered with one long beep; signal that the deadbolt 80 is locked or unlocked with two short beeps; signal that the deadbolt 80 failed to lock or unlock with one long beep; and signal low battery charge with one long beep after the lock/unlock beeps. Preferably, the controller 45 is programmed such that the assembly will cycle up to ten more times once the low battery indication occurs. After this, the final electric function in a low battery condition preferably implements a protocol to prevent the electronic locking function.

Figure 9:
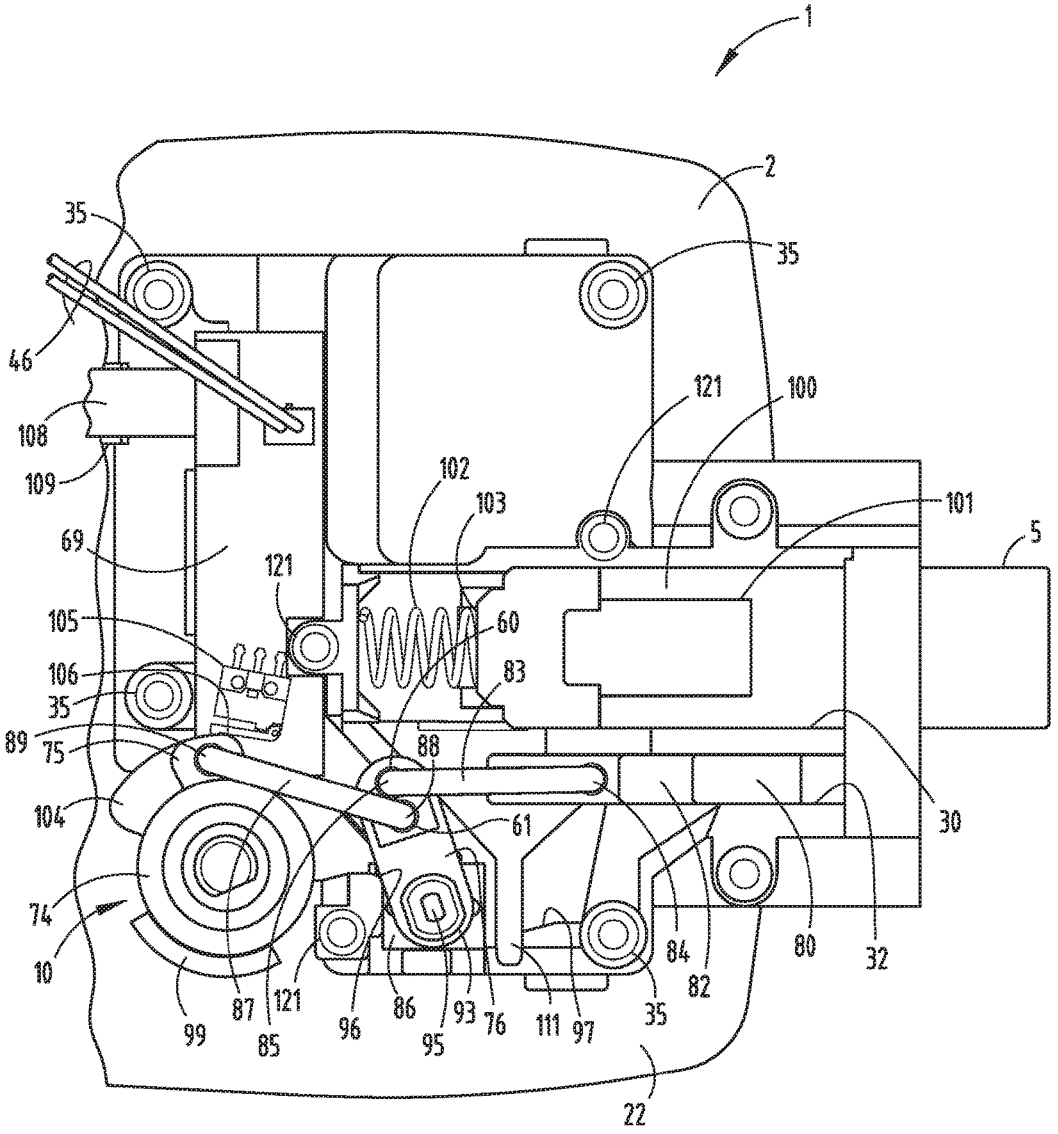
FIG. 9 is an elevational view of the first embodiment of the interior portion of the exterior housing plate of the lock assembly, shown with the latch plunger portion in a latched position, and latch lock and deadbolt lock portions thereof in an unlocked position.
Figure 9A:
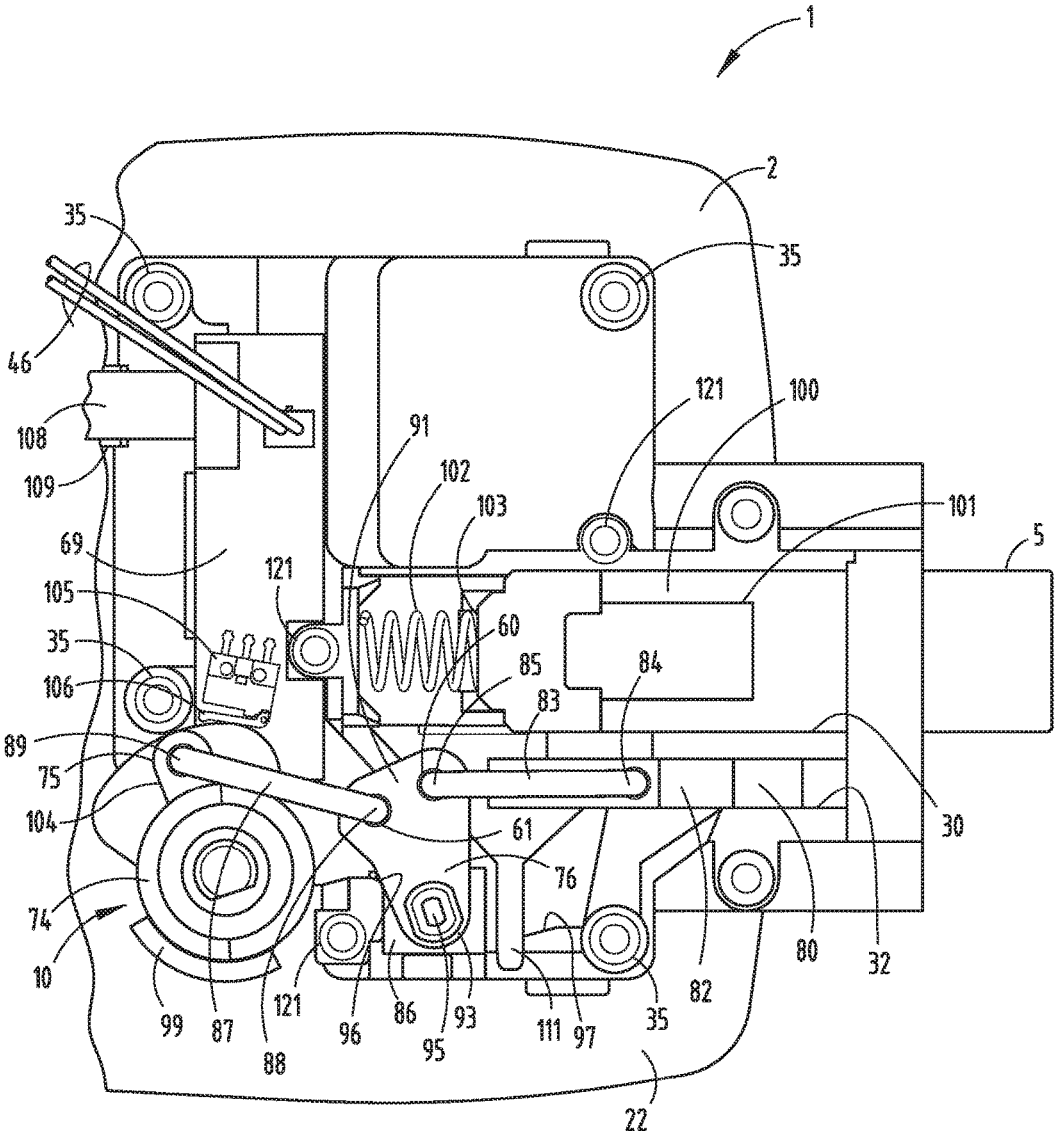
FIG. 9A is an elevational view of the interior portion of the exterior housing plate of the lock assembly, shown with the latch plunger portion in a latched position, and latch lock and deadbolt lock portions thereof in an unlocked position and an alternative embodiment of the motor crank arm.
Figure 10:
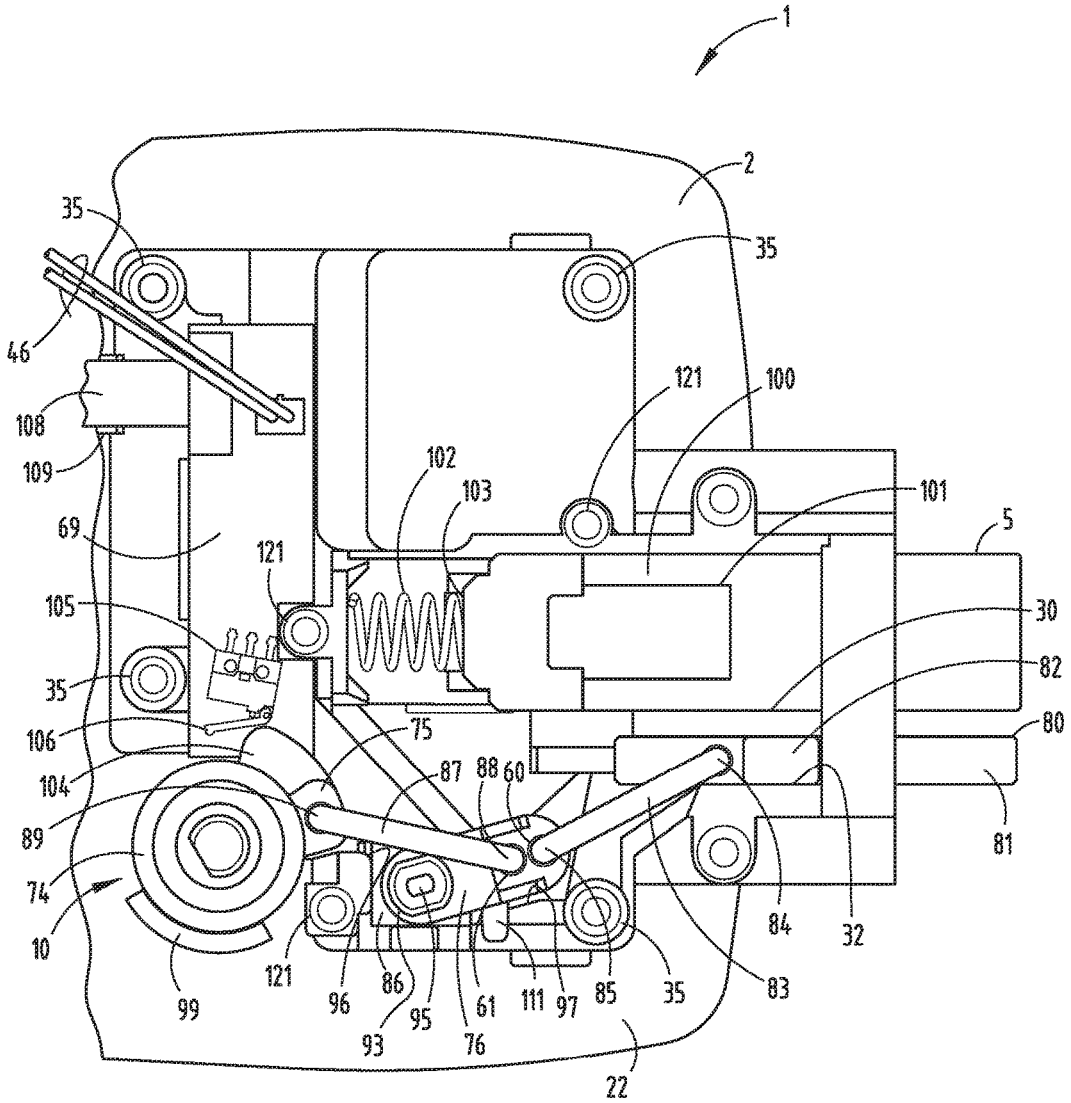
FIG. 10 is an elevational view of the first embodiment of the interior portion of the exterior housing plate of the lock assembly, shown with the latch plunger portion in a latched position, and deadbolt lock portions thereof in a locked position.
Figure 10A:
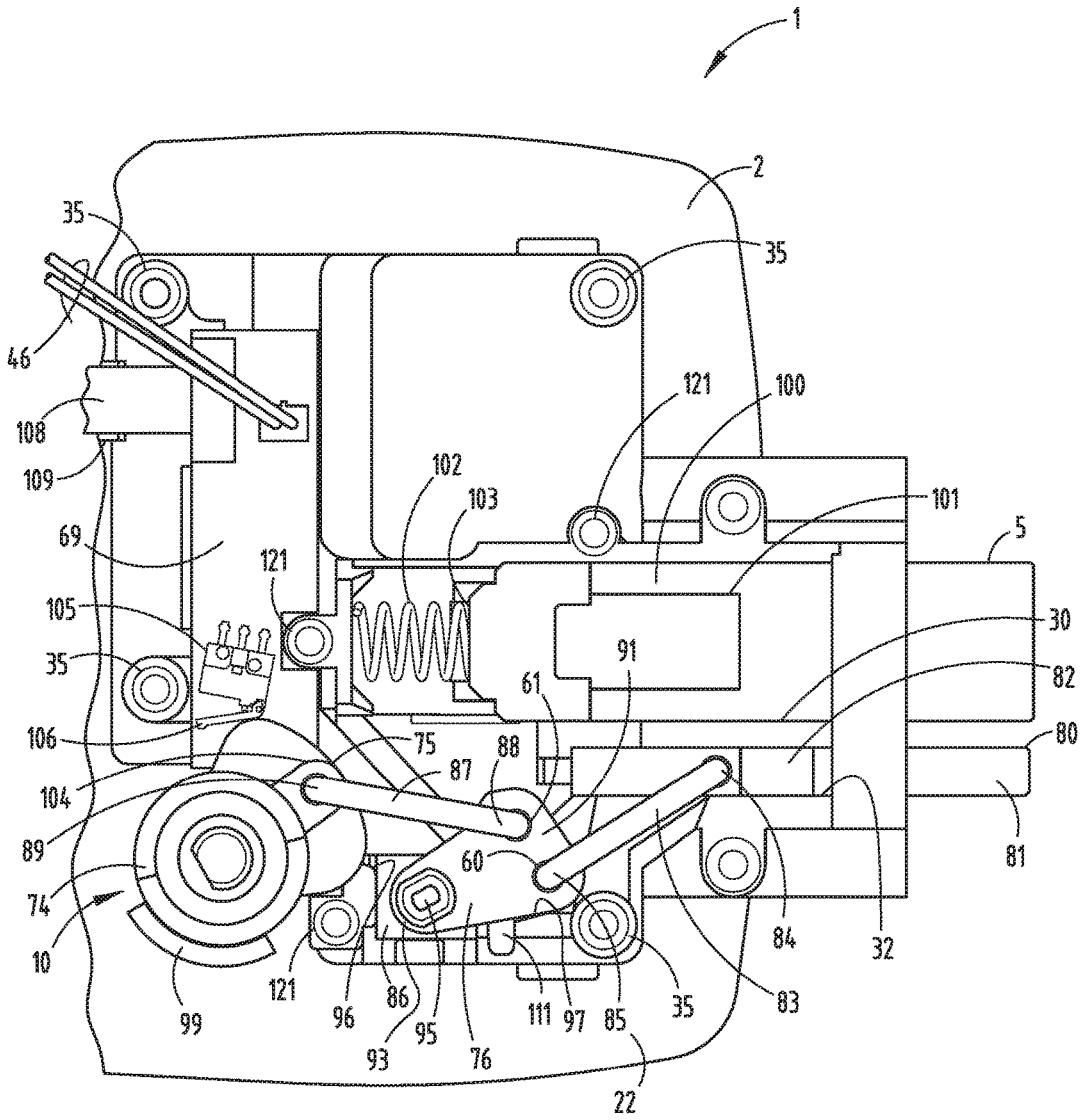
FIG. 10A is an elevational view of the first embodiment of the interior portion of the exterior housing plate of the lock assembly, shown with the latch plunger portion in a latched position, and deadbolt lock portions thereof in a locked position and an alternative embodiment of the motor crank arm.

The lock assembly 1 can also be equipped to sense the position of the deadbolt 80 and to determine if there is an obstruction to the dead bolt. As best seen in FIGS. 9-10A, a protruding sensor cam 104 is located approximately at 45 degrees counterclockwise around the lock crank arm 75, the sensor cam 104 having a projecting height approximately that of the lock crank arm 75. A micro switch 105 is mounted on the interior surface of the exterior housing plate 22, the micro switch 105 having a first end 106 positioned to be released by the sensor cam 104 of the lock crank arm 75 when the deadbolt 80 is in the locked position and depressed by the sensor cam 104 when the deadbolt in the unlocked position. Thus, depending on whether the micro switch 105 is depressed, the controller 45 is advised as to the state of the lock assembly 1.

Figure 20:
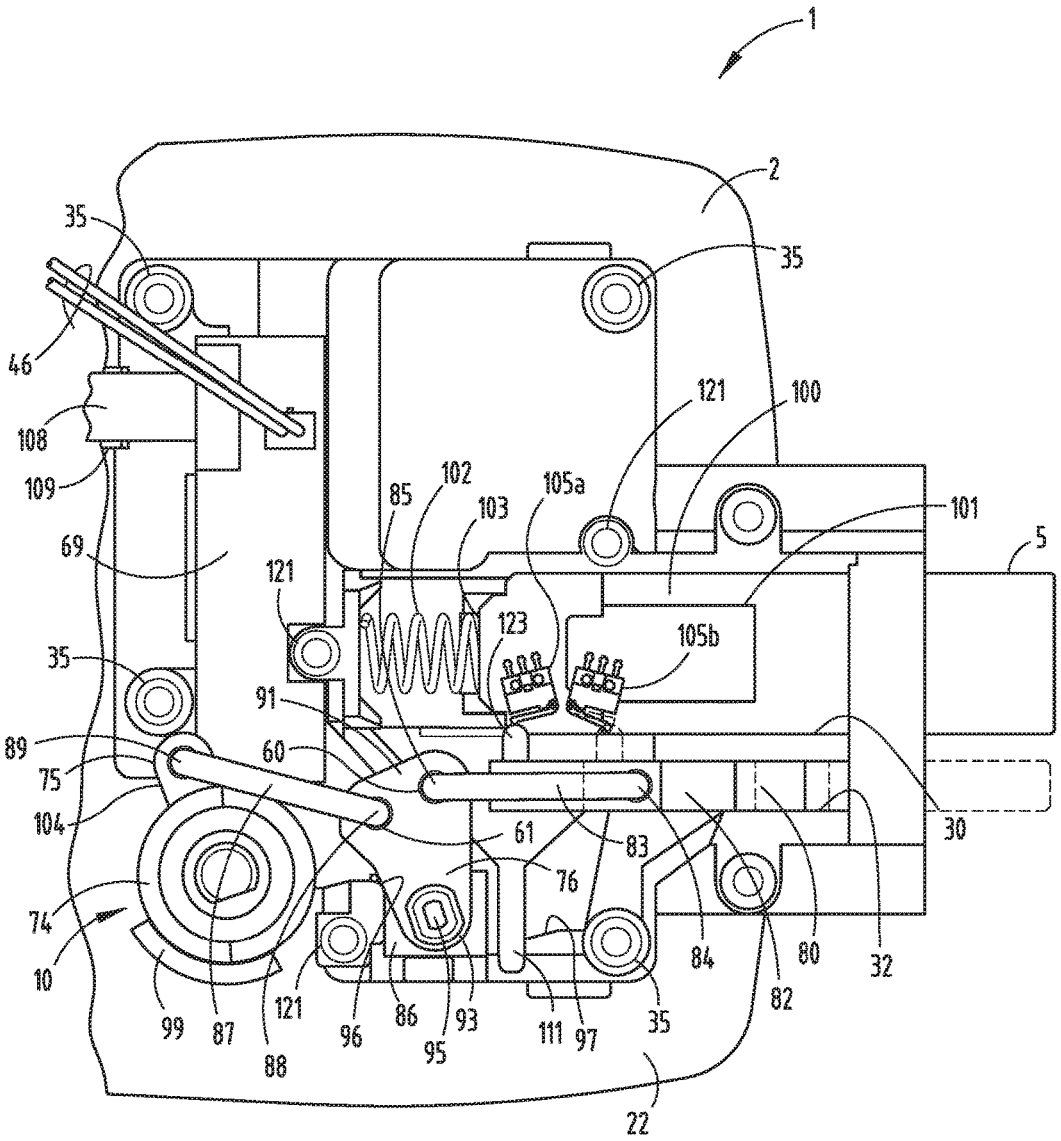
FIG. 20 is an elevational view of the interior portion of the exterior housing plate of the lock assembly, shown with the deadbolt lock portions thereof in an unlocked position, and depicting an alternative embodiment of the motor crank arm and deadbolt lock position sensing device.
Figure 21A:
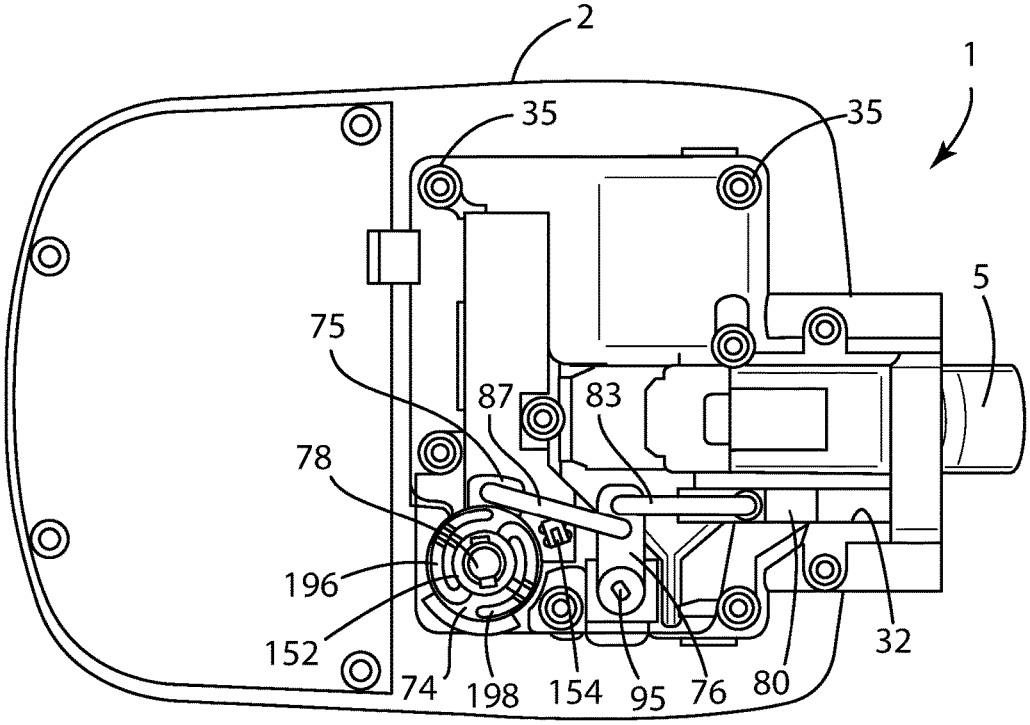
FIG. 21A is an elevational view of an alternative first embodiment of the interior portion of the exterior housing plate of the lock assembly, shown with the latch plunger portion in a latched position, and latch lock and deadbolt lock portions thereof in the unlocked position.
Figure 21B:
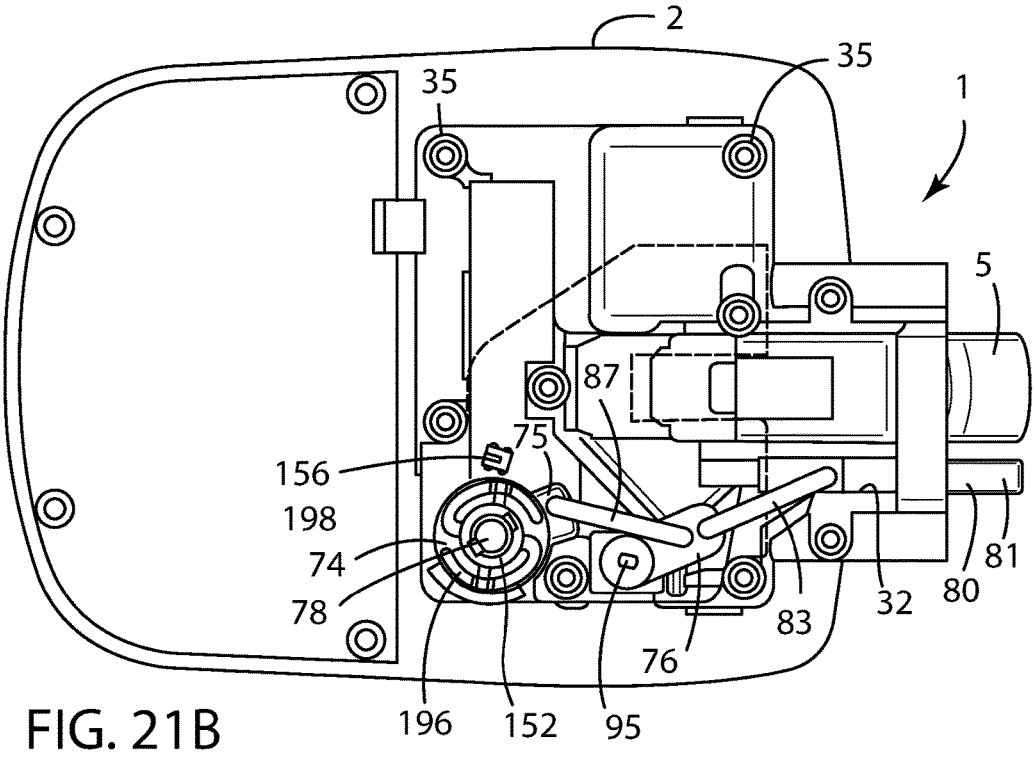
FIG. 21B is an elevational view of an alternative first embodiment of the interior portion of the exterior housing plate of the lock assembly, shown with the latch plunger portion in a latched position, and latch lock and deadbolt lock portions thereof in the locked position.

Alternatively, as shown in FIG. 20, a pair of micro switches 105*a*, 105*b*, also mounted on the interior surface of the exterior housing plate 22, may be disposed proximate a protruding tab 123 on the inner end 82 of the deadbolt 80, wherein translation of the deadbolt 80 from the unlocked to the locked position depresses micro switch 105*b* and translation of the deadbolt 80 back to the unlocked position depresses micro switch 105*a*. Thus, depending on which of the micro switches 105*a*, 105*b* is depressed, the controller 45 is advised as to the state of the lock assembly 1.

The lock assembly 1 described herein may also be adapted for operable connection with a remotely operated signaling device (such as a key fob, not shown). That is, the controller 45 may be programmed to interface with a built-in receiver to receive a signal from a remotely operated signaling device equipped with a transmitter to place the lock assembly 1 in the locked mode. In response to such a signal, the controller 45 then opens a switch to send electrical power to actuate the lock motor 86. Upon actuation of the lock motor 86, the lock motor 86 rotates the motor crank arm 76 clockwise, which shifts the first link 83 pivotally connected with motor crank arm 76 and the inner end 82 of deadbolt 80, and deadbolt 80 from the unlocked to the locked positions. The closure 3 may be unlocked in similar fashion.

As described above, the deadbolt key lock member 12 is directly and mechanically linked with the lock cam 74, motor crank arm 76 (and, hence, motor 86), and deadbolt 80. While efficient, the configuration shown above tends to apply a significant torque load to the motor 86 when a user manually actuates the deadbolt 80. In particular, when a user rotates the interior lock knob 52 from the interior of the recreational vehicle or rotates the deadbolt key 128 from the exterior of the recreational vehicle to shift the deadbolt 80 between the locked and unlocked positions, the motor crank arm 76 can occasionally apply an undesirably high torque to the stationary motor 86 to which it is operably coupled, resulting in potentially premature motor 86 failure.

In order to avoid the repeated and unnecessary application of torque to the motor 86 when the deadbolt 80 is manually shifted between the lock and unlock positions, an alternative embodiment for a lock cam 74 and motor crank arm 76 configuration can be seen in combination with a motor cam clutch 150 to help reduce the torque on the stationary motor 86 during manual actuation of the deadbolt 80, as shown in FIGS. 21A-25.

Figures 24, 25:
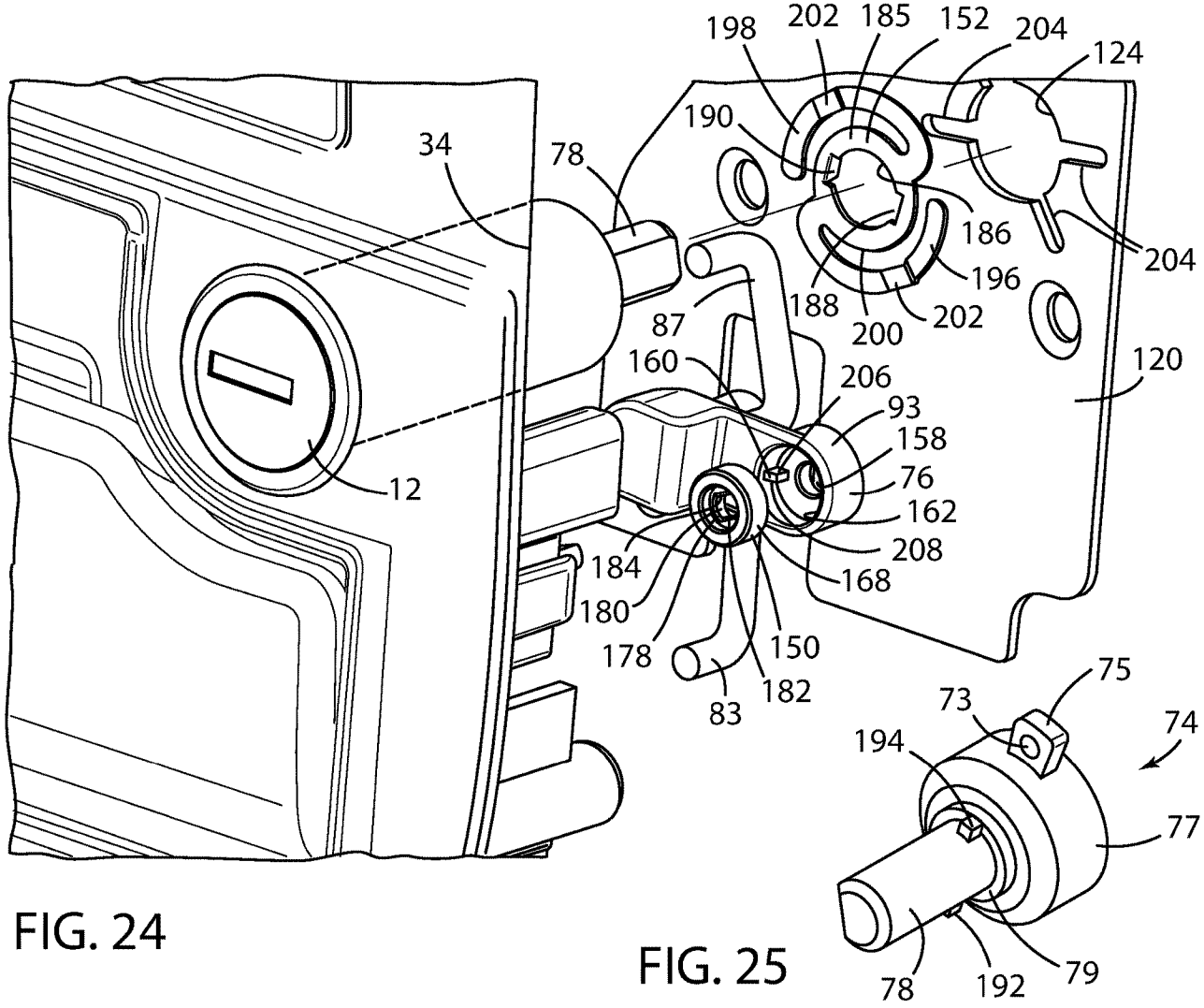
FIG. 24 is an exploded, perspective view of the alternative embodiment of the lock assembly, taken from an exterior side thereof.
FIG. 25 is an enlarged, perspective view of an alternative embodiment of the lock cam.

The alternative embodiment includes a modified lock cam 74 and motor crank arm 76 in combination with the motor cam clutch 150, a clutch spring 152, a locked limit micro switch 154, and an unlocked limit micro switch 156. In order to incorporate the motor cam clutch 150, the circular pad 93 of the motor crank arm 76 is provided with a motor crank arm recess 158, as best shown in FIG. 24, within which is received the motor cam clutch 150. The motor crank arm recess 158 has a substantially cylindrical configuration and includes a raised tab 160 disposed proximate an inner periphery 162 thereof that traverses approximately 15 to 20 degrees of the inner periphery 162 of the motor crank arm recess 158. The raised tab 160 may traverse more or less of the inner periphery 162 of the motor crank arm recess 158 than 15 to 20 degrees, so long as the raised tab 160 is robust enough to react against the loads applied to the raised tab 160 described herein and does not interfere with the rotation of the motor cam clutch 150 as described herein. The motor cam clutch 150 likewise has a substantially cylindrical configuration and has a first face 164 received within the motor crank arm recess 158 that is provided with a semicircular cutout 166 disposed about a portion of the outer periphery 168 of the motor cam clutch 150. The semicircular cutout 166 has a first engaging surface 170 and a second engaging surface 172 and preferably extends approximately 90 degrees about the inner periphery 162 of the motor cam clutch 150. The semicircular cutout 166 of the motor cam clutch 150 is preferably sized to receive the raised tab 160 disposed within the motor crank arm recess 158.

As shown in FIGS. 21A-24, the motor 86 is operably coupled with the motor crank arm 76 via the motor cam clutch 150. The motor cam clutch 150 is provided with a pair of opposed straight edges 174, 176 about an inner periphery 178 of a central orifice 180 disposed thereon. A pair of opposed flats 182, 184 on the motor shaft 95 engage the opposed straight edges 174, 176 in the central orifice 180 of the motor cam clutch 150 to provide a direct mechanical linkage between the motor 86 and the motor cam clutch 150. When so situated, the motor shaft 95 is adapted to drive the motor cam clutch 150, wherein the raised tab 160 within the motor crank arm recess 158 of the motor crank arm 76 may be engaged by the first engaging surface 170 of the motor cam clutch 150 to displace the motor crank arm 76 to a first position corresponding to the unlocked position of the deadbolt 80, as shown in FIGS. 21A, 22B, 22C, and 22F. Conversely, motor shaft 95 is situated to drive the motor cam clutch 150 so that the raised tab 160 within the motor crank arm recess 158 of the motor crank arm 76 is engaged by the second engaging surface 172 of the motor cam clutch 150 to displace the motor crank arm 76 to a second position corresponding to the locked position of the deadbolt 80, as shown in FIGS. 21B, 22A, 22D, and 22E.

In addition, the clutch spring 152 is preferably disposed between the stop or collar 79 on the lock cam 74 and the interior backing plate 120. The clutch spring 152 is preferably fabricated from spring steel and is provided with a central portion 185 having an opening 186 that receives the faced shaft 78 and abuts the stop or collar 79 of the lock cam 74. A pair of opposed radial slots 188, 190 is disposed on opposite sides of the central opening 186 of the clutch spring 152 and is disposed to receive a corresponding pair of opposed tabs 192, 194 extending radially from the axis of the lock cam 74 proximate the intersection of the faced shaft 78 and the stop or collar 79 of the lock cam 74. Thus, the clutch spring 152 is mechanically and operably coupled with the lock cam 74 and rotates in accordance with the rotation of the lock cam 74.

Figure 23:
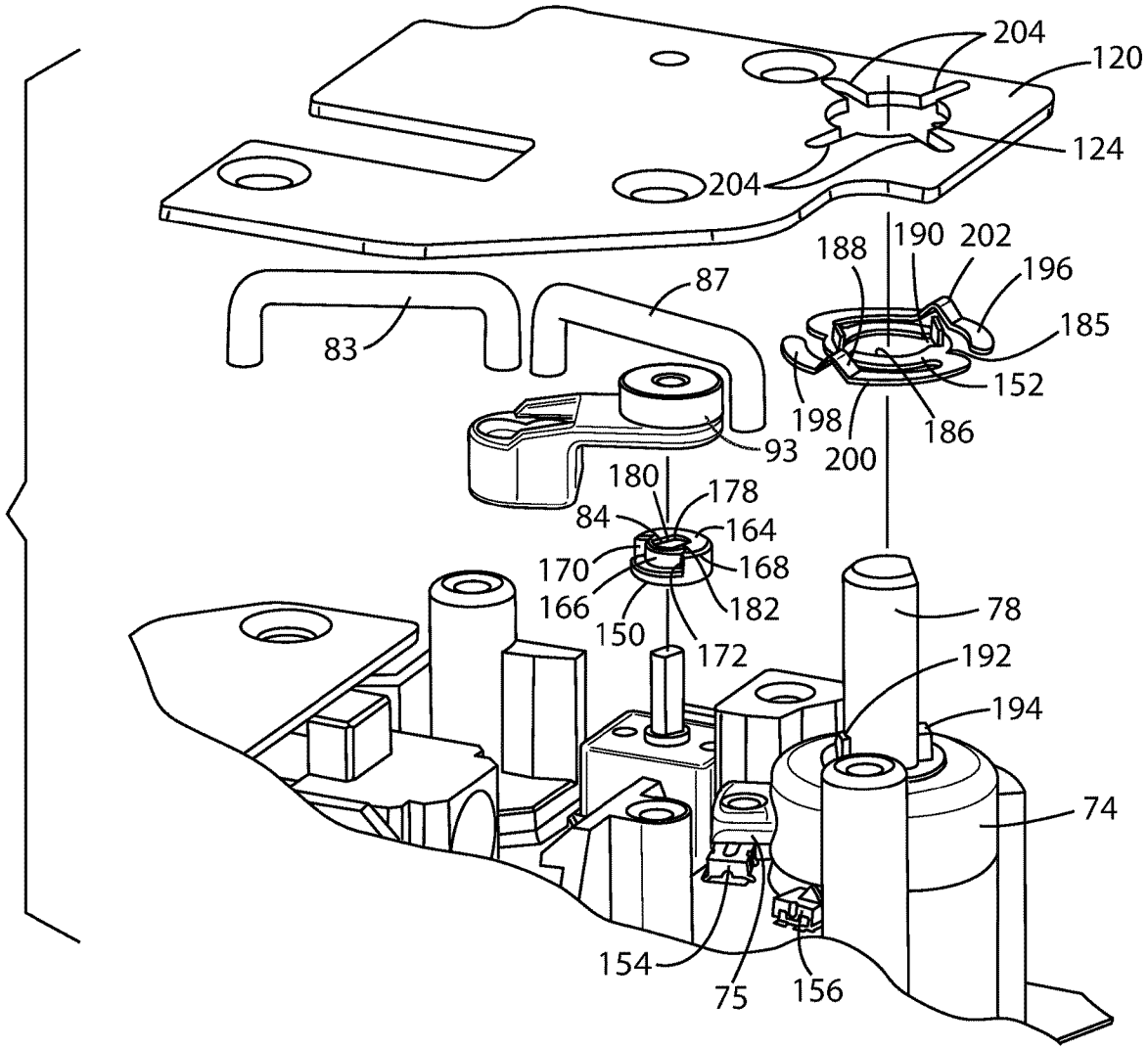
FIG. 23 is an exploded, perspective view of the alternative embodiment of the lock assembly, taken from an interior side.

Preferably, a pair of opposed circular outer edges, more preferably as shown comprised of arms 196, 198, extends about an outer periphery 200 of the clutch spring 152. Each of the opposed circular arms 196, 198 is provided with an outwardly extending detent 202. The recess 124 on the interior backing plate 120, which is axially positioned to receive the faced shaft 78 and abut the stop or collar 79 of the lock cam 74 and preferably sized so as to prevent the axis of lock cam 74 from moving vertically or horizontally and in rotation only, as noted above, is provided with a set of preferably four slots 204 disposed about and extending radially from the recess 124 at approximately 90 degree intervals, as shown in FIGS. 23 and 24. It should be appreciated that the opposed circular arms 196, 198 may be attached at either end thereof to the central portion 185 of the clutch spring 152, as opposed to only one end, as shown.

In both manual and powered operation, the lock cam 74 is rotated in approximately 90 degree increments between the locked and unlocked positions and vice versa. In manual operation, rotation of the lock cam 74 by either the key lock member 12 or the interior lock knob 52 causes rotation of the motor crank arm 76 operatively coupled thereto via the second link 87 between the locked and unlocked positions and simultaneously longitudinally shifts the deadbolt 80 between the locked and unlocked positions via the first link 83. In powered operation, rotation of the motor shaft 95 rotates motor crank arm 76 between the locked and unlocked positions and simultaneously longitudinally shifts the deadbolt 80 between the locked and unlocked positions via the first link 83. Preferably, each of the pair of outwardly extending detents 202 on each of the opposed circular arms 196, 198 of the clutch spring 152 resiliently engage an opposed pair of slots 204 disposed about the recess 124 in each of the locked and unlocked positions to ensure that the lock cam 74 remains in position when rotated within the recess 124.

In operation, the motor cam clutch 150 allows manual rotation of the lock cam 74 between the locked and unlocked position without necessarily requiring rotation of the motor shaft 95 that is mechanically and operably coupled with the motor cam clutch 150, as the motor crank arm 76 is similarly rotated. That is, the motor crank arm 76 can be driven by manual rotation of the lock cam 74 through the second link 87, but does not necessarily impose a torque load on the motor 86.

Figure 22A:
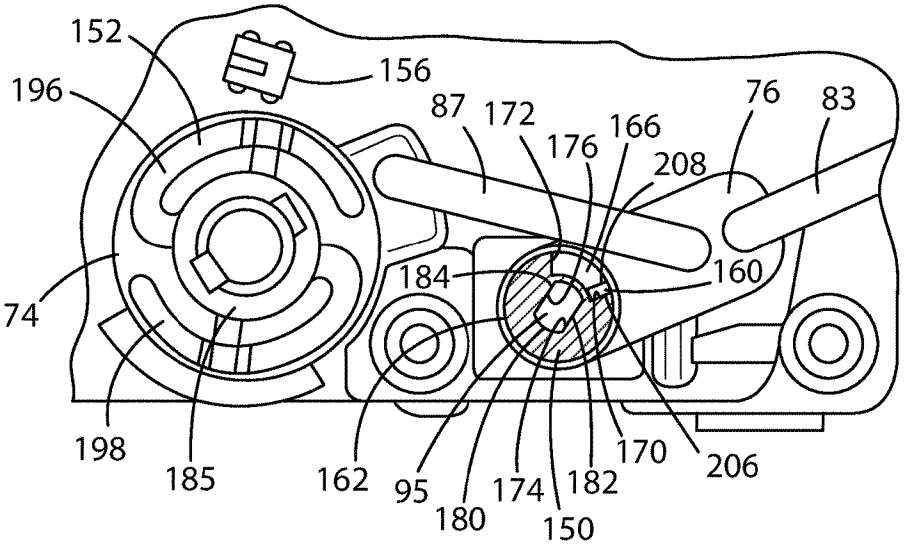
FIG. 22A is an enlarged elevational view of the alternative first embodiment of the interior portion of the exterior housing plate of the lock assembly of FIG. 21A, shown with the lock cam and motor crank arm in the locked position relative a first position of the motor cam clutch.
Figure 22B:
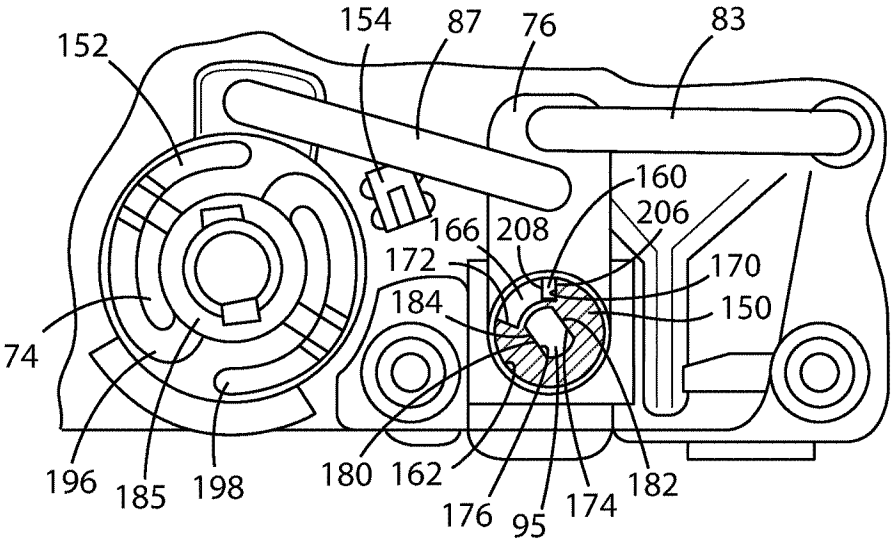
FIG. 22B is an enlarged elevational view of the alternative first embodiment of the interior portion of the exterior housing plate of the lock assembly of FIG. 22A, shown with the lock cam and motor crank arm in the unlocked position relative a second position of the motor cam clutch.
Figure 22C:
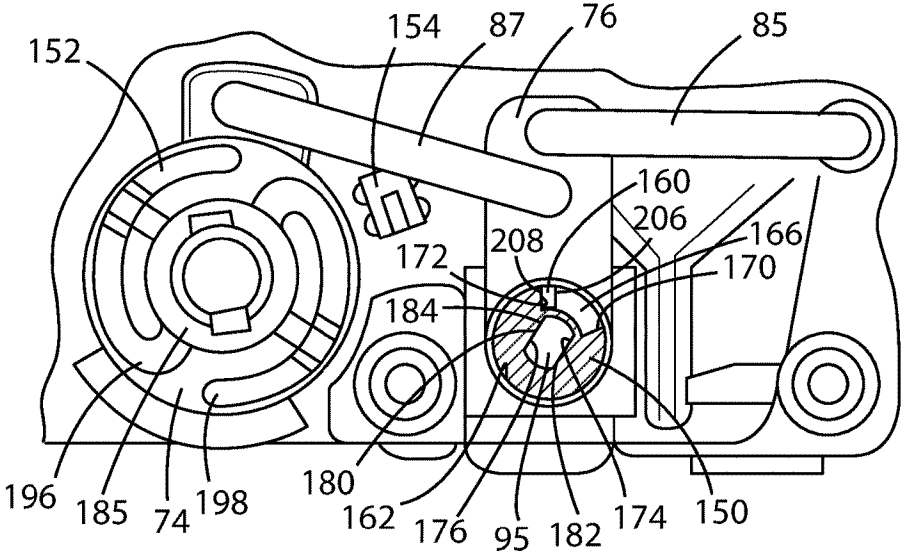
FIG. 22C is an enlarged elevational view of the alternative first embodiment of the interior portion of the exterior housing plate of the lock assembly of FIG. 21A, shown with the lock cam and motor crank arm in the unlocked position relative the first position of the motor cam clutch.
Figure 22D:
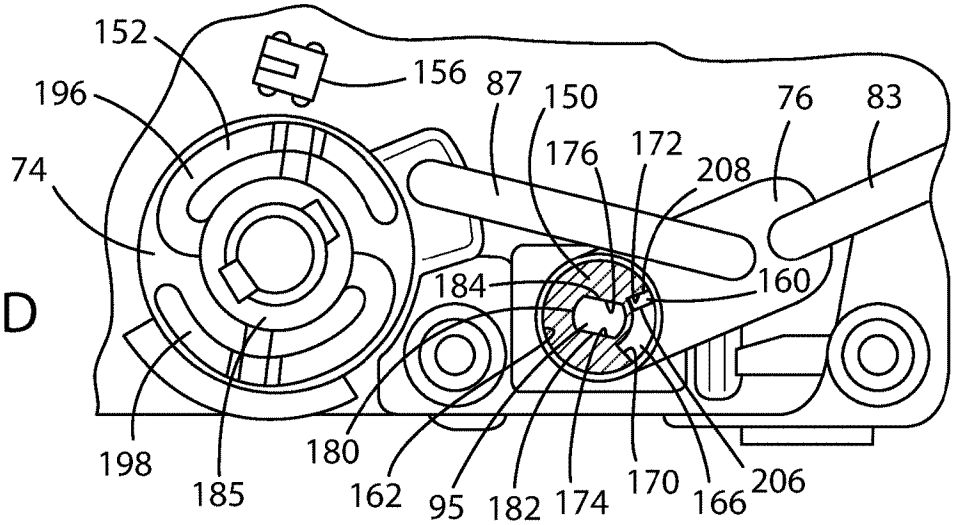
FIG. 22D is an enlarged elevational view of the alternative first embodiment of the interior portion of the exterior housing plate of the lock assembly of FIG. 22A, shown with the lock cam and motor crank arm in the locked position relative a third position of the motor cam clutch.

For example, with reference to FIGS. 22A-22D, when an operator seeks to unlock the deadbolt 80 electronically via touch pad 36 or other input device, such as a key fob (not shown), as discussed above, and the motor 86 and motor cam clutch 150 are in the position as shown in FIG. 22D, the motor 86 is electrically actuated to rotate the motor shaft 95 counterclockwise, which, in turn, rotates the motor cam clutch 150 counterclockwise until the first engaging surface 170 is brought into engagement with a first side 206 of the raised tab 160 disposed within the motor crank arm recess 158, if it has not already been placed at that position manually, as discussed below and as shown in FIG. 22A. The first engaging surface 170 of the motor cam clutch 150 then pushes against the first side 206 of the raised tab 160 disposed within the motor crank arm recess 158 and continues to rotate the motor crank arm 76 counterclockwise, which is also linked with the lock cam 74 via the second link 87, until the unlocked limit micro switch 156 is reached and actuated by the crank arm 75 of the lock cam 74. With the motor crank arm 76 fully rotated counterclockwise, as shown in FIG. 22B, the first link 83 pulls on the deadbolt 80 to place it in the unlocked position. The closure 3 may now be opened. This rotation corresponds to approximately a 90 degree counterclockwise rotation for all components involved.

When the operator subsequently enters the recreational vehicle and seeks to manually relock the deadbolt 80, the operator may then manually rotate the interior lock knob 52 clockwise, which rotates the lock cam 74 clockwise as well. Since the motor crank arm 76 is linked via the second link 87 with the lock cam 74, the motor crank arm 76 is rotated clockwise as well. With the motor crank arm 76 linked to the deadbolt 80 via the first link 83, the deadbolt 80 is displaced from the unlocked to the locked position. However, as the motor cam clutch 150 is operably interposed between the motor crank arm 76 and the stationary motor shaft 95, the first engaging surface 170 may already be in contact with the first side 206 of the raised tab 160, as shown in FIG. 22B. Thus, manual rotation of the motor crank arm 76 rotates the motor cam clutch 150 and motor shaft 95 to the position shown in FIG. 22A. Rotation of the lock cam 74 and motor crank arm 76 therefore imposes a torque load on the motor shaft 95, but, as noted below, this torque load is significantly reduced during further manual operation by the presence of the semicircular cutout 166 in the motor cam clutch 150.

In particular, when the operator seeks to manually unlock the deadbolt 80 via manual rotation of the lock knob 52 counterclockwise from the position shown in FIG. 22A, the motor crank arm 76 will not rotate the motor cam clutch 150, but will rather merely bring the second engaging surface 172 back into contact with an opposite side 208 of the raised tab 160, as shown in FIG. 22C. Therefore, the motor 86 will not experience the effects of manual operation between the locked and unlocked positions, which will thereby prevent wear and tear on the motor 86 and motor gears therein (not shown). The manual operation noted above relating to the lock knob 52 likewise applies to operation of the lock cam 74 via the movable deadbolt key lock member 12 between the locked and unlocked positions.

When the operator subsequently exits the recreational vehicle and seeks to relock the deadbolt 80 via the touch pad 36 or other input device after leaving the recreational vehicle, the motor 86 is electrically actuated to rotate the motor shaft 95 clockwise, which, in turn, ultimately rotates the motor cam clutch 150 clockwise to the position shown in FIG. 22D. If the second engaging surface 172 of the motor cam clutch 150 is not already in engagement with the second side 208 of the raised tab 160 at the commencement of this operation, as shown in FIG. 22B, the motor clam clutch 150 is rotated by the motor 86 until the second engaging surface 172 is brought into engagement with second side 208 of the raised tab 160. Once the second engaging surface 172 of the motor cam clutch 150 is in engagement with the second side 208 of the raised tab 160 disposed, as shown in FIG. 22C, the second engaging surface 172 of the motor cam clutch 150 then pushes against the second side 208 of the raised tab 160 and continues to rotate the motor crank arm 76 and the lock cam 74 clockwise, the latter being linked with the motor crank arm 76 via the second link 87, until the locked limit micro switch 154 is reached and actuated by the crank arm 75 of the lock cam 74, as shown in FIG. 22D. With the motor crank arm 76 rotated clockwise, the first link 83 pushes the deadbolt 80 to place it in the locked position. This rotation again corresponds to approximately a 90 degree clockwise rotation for all components involved. It has been found that the use of both a locked limit micro switch 154 and an unlocked limit micro switch 156 directly actuated by the crank arm 75 of the lock cam 74 allows the motor 86 to more reliably displace the deadbolt 80 between the locked and unlocked positions.

Alternatively, when the operator subsequently exits the recreational vehicle and seeks to manually relock the deadbolt 80, the operator may then manually rotate the lock cam 74 via the movable deadbolt key lock member 12 clockwise. If the motor cam clutch 150 is in the position shown in FIG. 22C, and the first engaging surface 170 of the motor cam clutch 150 is not already in engagement with the first side 206 of the raised tab 160 at the commencement of this operation, the motor crank arm 76 will not rotate the motor cam clutch 150, but will rather merely bring the first engaging surface 170 back into contact with the first side 206 of the raised tab 160, as shown in FIG. 22A. If the motor cam clutch is in the position shown in FIG. 22B, manual clockwise rotation of the motor crank arm 74 will rotate the motor clam clutch 150 and motor shaft 95 against the first engaging surface 170 already in engagement with first side 206 of the raised tab 160, until the deadbolt 80 is placed in the locked position, as shown in FIG. 22A.

Figure 22E:
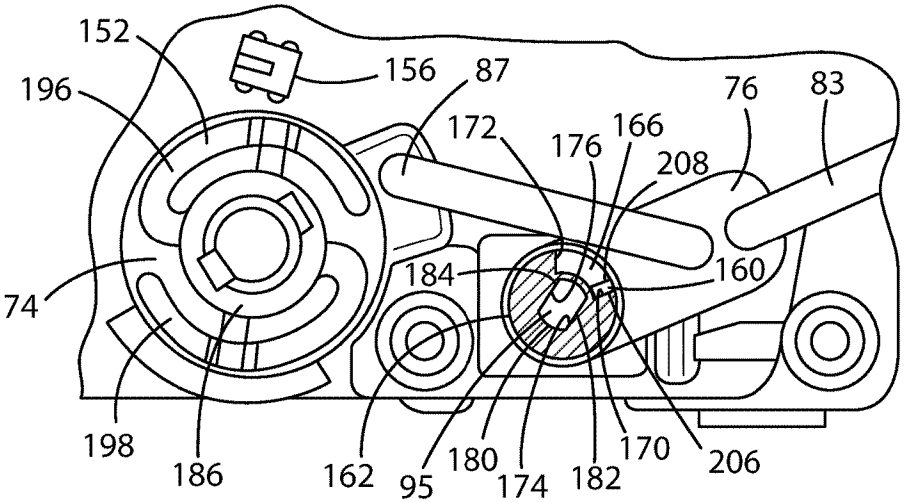
FIG. 22E is an enlarged elevational view of the alternative first embodiment of the interior portion of the exterior housing plate of the lock assembly of FIG. 22A, shown with the lock cam and motor crank arm in a neutral position relative the motor cam clutch.
Figure 22F:
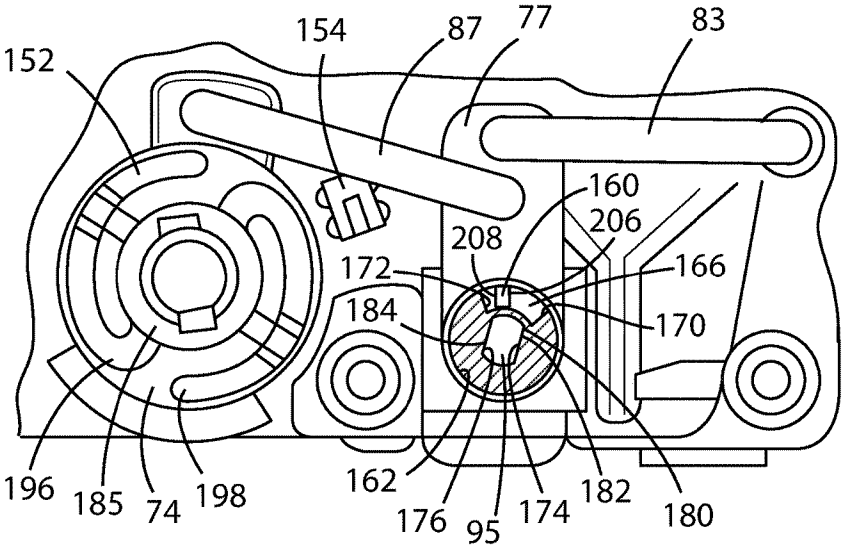
FIG. 22F is an enlarged elevational view of the alternative first embodiment of the interior portion of the exterior housing plate of the lock assembly of FIG. 22A, shown with the lock cam and motor crank arm in a neutral position relative the motor cam clutch.

As a further refinement, the control logic for the motor 86 preferably may be adjusted as the motor 86 operates the deadbolt 80 between the locked or unlocked positions. That is, owing to the semicircular cutout 166 in the motor cam clutch 150, once the locked or unlocked limit micro switches 154, 156 are actuated, the motor 86 can then be operated in reverse and backed off a predetermined interval to a neutral position in order to minimize the impact of a manual operation, as shown in FIGS. 22E and 22F.

In particular, it is contemplated that after either of the locked limit micro switch 154 or an unlocked limit micro switch 156 is contacted, the motor 86 can be rotated in the opposite direction, preferably by a predetermined interval of 35-45 degrees, to displace the first or second engaging surfaces 170, 172 of the motor cam clutch 150 away from either the first or second sides 208, 206 of the raised tab 160 disposed within the motor crank arm recess 158, respectively. This feature has been found to further reduce wear and tear on the motor 86.

Given the presence of the controller 45 and motor 86, the presence of water internal to the lock assembly 1 is highly undesirable, thus it is highly desirable to allow water to exit the lock assembly 1. Accordingly, diversion channels 110 are provided on the internal surface of the external plate 22 to divert water between the external plate 22 and the internal plate 23 away from the motor 86 and controller 45, regardless of how the lock assembly 1 might be mounted to the closure 3, as shown in FIGS. 2-3. For example, in the case of the lock assembly 1 being mounted on the right side of the closure 3, from inside the closure 3, as shown in FIGS. 1-3, the diversion channels 110 form a funnel 111 next to the motor 86 so that the water preferentially flows harmlessly by, but not in touch with, the motor 86. In the case of the lock assembly 1 being mounted on the left side of the closure 3, from inside the closure 3 (not shown), the motor 86 is located relatively high in the lock assembly 1, such that any water in the lock assembly 1 flows away from the motor 86 and out of the lock assembly 1.

Additional water control may be obtained by the use of water diversion provided on the external surface of the exterior housing plate 22. The water diversion includes an elevated rib 113 extending completely about handle recess 24. Water encountering the elevated rib 113 will tend to flow around the handle recess 24 due to capillary action and then fall to the ground. A similar elevated rib 114 is formed around lock aperture 27 on the surface of the exterior housing plate 22. An elevated, generally triangularly shaped base 115 having channels 116 on either angled side is formed near the actuator window 25, such that water flowing near the actuator window 25 is forced to flow away from the actuator window 25 and does not flow into the interior of the lock assembly 1 in the first instance. Due to the symmetrical wedge-shape of the base 115, the assembly may be mounted on either right-hand or left-hand hinged doors. Additionally, a web 117, best shown in FIG. 4, is provided on actuator tab 26 to prevent water from entering the interior of the housing 2 via the actuator window 25 in the event that water is sprayed directly at the paddle handle 4. That is, the web 117 effectively seals actuator window 25 when the paddle handle 4 is in the retracted position.

In accordance with the foregoing description, an improved lock assembly has been disclosed which includes an integral touch pad lock control coupled with a handle mechanism that is convenient for the consumer, in that keys and key fobs are not needed to actuate the lock. Relatively large, illuminated capacitive touch buttons allow for ease of use. The described latch assembly readily fits in existing recreational vehicle doors, and consumers can replace an existing mechanical travel trailer latch with the improved latch assembly. This is especially made possible due to the self-contained power source of the improved latch assembly that requires no external wiring.

In the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the terms "coupled" (in all of its forms, couple, coupling, coupled, etc.) and "connected" (in all of its forms, connect, connecting, connected, etc.) generally mean the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposed of this disclosure, the term "operably coupled" or "operably connected" generally means that one component functions with respect to another component, even if there are other components located between the first and second component, and the term "operable" defines a functional relationship between components.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structure without departing from the concepts of the present invention, and further it is to be understood that such concepts are intended to be covered by the following claims unless these claims by their language expressly state otherwise.

The invention claimed is as follows:

1. A lock assembly adapted for mounting adjacent an associated closure of the type that can be shifted between an open position and a closed position, the lock assembly comprising:

a housing;

an external handle mounted in an exterior portion of the housing for actuation between a first position and a second position;

a latch plunger operably connected with the external handle and configured such that when the external handle is in the first position, the latch plunger is in a latched position, wherein the closure cannot be unintentionally shifted from the closed position, and when the external handle is in the second position, the latch plunger is in an unlatched position, wherein the closure is free to be shifted from the closed position to the open position;

a lock cam rotatably mounted in the housing having a locked and unlocked position;

a motor;

a motor cam clutch operably coupled with the motor and operably interposed between the lock cam and the motor;

a deadbolt lock movably mounted in the housing and operatively coupled with each of the lock cam and the motor for shifting between a locked position, wherein the closure is positively retained in the closed position, and an unlocked position, wherein the closure is free to be shifted between the open and closed positions; and an input device operatively connected with the motor, whereby actuation of the input device actuates the motor and contemporaneously shifts the deadbolt lock between the locked and unlocked positions.

2. A lock assembly of claim 1, further comprising a motor crank arm operatively coupled with each of the motor and the lock cam, and the motor cam clutch is interposed between the motor crank arm and the motor.

3. The lock assembly of claim 2, wherein actuation of the motor rotates the motor crank arm to shift the deadbolt lock between the locked and unlocked positions.

4. The lock assembly of claim 2, further comprising:

a first link operably connecting the motor crank arm with the deadbolt lock.

5. A lock assembly adapted for mounting adjacent an associated closure of the type that can be shifted between an open position and a closed position, the lock assembly comprising:

a housing;

an external handle mounted in an exterior portion of the housing for actuation between a first position and a second position;

a latch plunger operably connected with the external handle and configured such that when the external handle is in the first position, the latch plunger is in a latched position, wherein the closure cannot be unintentionally shifted from the closed position, and when the external handle is in the second position, the latch plunger is in an unlatched position, wherein the closure is free to be shifted from the closed position to the open position;

a lock cam rotatably mounted in the housing having a locked and unlocked position;

a motor;

a motor cam clutch operably coupled with the motor and operably interposed between the lock cam and the motor;

a motor crank arm operatively coupled with each of the motor and the lock cam, and the motor cam clutch being interposed between the motor crank arm and the motor;

a deadbolt lock movably mounted in the housing and operatively coupled with each of the lock cam and the motor for shifting between a locked position, wherein the closure is positively retained in the closed position, and an unlocked position, wherein the closure is free to be shifted between the open and closed positions;

an input device operatively connected with the motor, whereby actuation of the input device actuates the motor and contemporaneously shifts the deadbolt lock between the locked and unlocked positions;

a first link operably connecting the motor crank arm with the deadbolt lock; and a second link operably connecting with the motor crank arm and the lock cam, wherein rotation of the lock cam operates through the second link to rotate the motor crank arm and rotation of the motor crank arm operates through the first link to shift the deadbolt lock between the locked and unlocked positions.

6. The lock assembly of claim 5, wherein the motor crank arm comprises a motor crank arm recess within which is received the motor cam clutch, the motor crank arm recess having a substantially cylindrical configuration and the motor cam clutch likewise having a substantially cylindrical configuration.

7. The lock assembly of claim 6, wherein the motor crank arm recess comprises a raised tab disposed proximate an inner periphery of the motor crank arm recess and the motor cam clutch comprises a first face received within the motor crank arm recess, the first face of the motor cam clutch having a semicircular cutout disposed about a portion of the outer periphery of the motor cam clutch sized to receive the raised tab disposed within the motor crank arm recess.

8. The lock assembly of claim 7, wherein the semicircular cutout has a first engaging surface and a second engaging surface.

9. The lock assembly of claim 8, wherein the semicircular cutout extends approximately 90 degrees about the outer periphery of the motor cam clutch.

10. The lock assembly of claim 7, wherein the raised tab disposed proximate the inner periphery of the motor crank arm recess traverses approximately 15 to 20 degrees of the inner periphery of the motor crank arm recess.

11. The lock assembly of claim 6, wherein the motor cam clutch is provided with a pair of opposed straight edges about a central orifice disposed thereon and a pair of opposed flats on a motor shaft of the motor engage the straight edges in the orifice of the motor cam clutch.

12. The lock assembly of claim 8, wherein actuation of the motor in a first direction rotates the motor cam clutch in a first direction until the first engaging surface is brought into engagement with a first side of the raised tab, whereupon the first engaging surface of the motor cam clutch pushes against the first side of the raised tab and continues to rotate the lock cam and the motor crank arm in the first direction until the deadbolt lock is placed in the unlocked position.

13. The lock assembly of claim 12, wherein the rotation in the first direction corresponds to approximately a 90 degrees counterclockwise rotation for the motor crank arm and lock cam.

14. The lock assembly of claim 12, wherein subsequent actuation of an interior lock knob or an exterior key member in a second direction rotates the lock cam and motor crank arm in a second direction until the second engaging surface is brought into contact with an opposite second side of the raised tab, whereupon the second engaging surface of the motor cam clutch pushes against the second side of the raised tab and continues to rotate the lock cam and the motor crank arm in the second direction until the deadbolt lock is placed in the locked position.

15. The lock assembly of claim 14, wherein subsequent actuation of the interior lock knob or the exterior key member in the first direction rotates the lock cam and motor crank arm in the first direction until the first engaging surface is brought into contact with the first side of the raised tab, whereupon the first engaging surface of the motor cam clutch pushes against the first side of the raised tab and continues to rotate the lock cam and the motor crank arm in the first direction until the deadbolt lock is placed in the unlocked position.

16. The lock assembly of claim 15, wherein subsequent actuation of the motor rotates the motor cam clutch in the second direction until the second engaging surface of the motor cam clutch is brought into contact with the second side of the raised tab, whereupon the second engaging surface of the motor cam clutch pushes against the second side of the raised tab and continues to rotate the lock cam and the motor crank arm in the second direction until the deadbolt lock is placed in the locked position.

17. The lock assembly of claim 15, further comprising an unlocked limit micro switch and a locked limit micro switch each directly actuated by the lock cam that corresponds to the deadbolt lock being in the unlocked and locked position, respectively.

18. A lock assembly adapted for mounting adjacent an associated closure of the type that can be shifted between an open position and a closed position, the lock assembly comprising:

a housing;

an external handle having a first position and a second position;

a latch plunger operably connected with the external handle and configured such that when the external handle is in the first position, the latch plunger is in a latched position, wherein the closure cannot be unintentionally shifted from the closed position, and when the external handle is in the second position, the latch plunger is in an unlatched position, wherein the closure is free to be shifted from the closed position to the open position;

a lock cam rotatably mounted in the housing about an axis of the lock cam having a locked and unlocked position;

a motor;

a motor crank arm operatively coupled with each of the motor and the lock cam;

a motor cam clutch operably coupled with the motor and operably interposed between the motor crank arm and the motor;

a deadbolt lock movably mounted in the housing and operatively coupled with each of the lock cam and the motor for shifting between a locked position, wherein the closure is positively retained in the closed position, and an unlocked position, wherein the closure is free to be shifted between the open and closed positions; and an input device operatively connected with the motor, whereby actuation of the input device actuates the motor and contemporaneously shifts the deadbolt lock between the locked and unlocked positions.

19. The lock assembly of claim 18, wherein the deadbolt lock includes a deadbolt slidably mounted in the housing with an outer end thereof that extends exterior of the housing for engagement with an associated strike adjacent the closure, an inner end thereof which extends interior of the housing, a link having a first end thereof pivotally connected with the inner end of the deadbolt lock, and a second end thereof operatively connected with the lock cam, such that actuation of the motor between the locked and unlocked positions longitudinally shifts the deadbolt lock between the locked and unlocked positions.

20. The lock assembly of claim 19, further comprising an external key lock assembly operably connected with the lock cam for rotation therewith, such that shifting the key lock assembly between a locked position and an unlocked position shifts the deadbolt lock between the locked and unlocked positions.

21. The lock assembly of claim 20, further comprising an interior lock actuator mounted on an interior portion of the housing, and operably connected with the lock cam for rotation therewith, such that shifting the interior lock actuator between locked and unlocked positions shifts the deadbolt lock between the locked and unlocked positions.

22. The lock assembly of claim 21, wherein rotation of the lock cam by either the key lock assembly or the interior lock actuator causes rotation of the motor crank arm operatively coupled thereto between a locked position and an unlocked position and simultaneously longitudinally shifts the deadbolt lock between the locked and unlocked positions without rotation of the motor cam clutch.

23. The lock assembly of claim 19, wherein rotation of the motor rotates the lock cam between the locked and unlocked positions and simultaneously longitudinally shifts the deadbolt lock between the locked and unlocked positions.

24. A lock assembly of claim 18, wherein the motor cam clutch allows rotation of the lock cam between the locked and unlocked position without rotating a motor shaft of the motor.

25. A lock assembly adapted for mounting adjacent an associated closure of the type that can be shifted between an open position and a closed position, the lock assembly comprising:

a housing;

an external handle having a first position and a second position;

a latch plunger operably connected with the external handle and configured such that when the external handle is in the first position, the latch plunger is in a latched position, wherein the closure cannot be unintentionally shifted from the closed position, and when the external handle is in the second position, the latch plunger is in an unlatched position, wherein the closure is free to be shifted from the closed position to the open position;

a lock cam rotatably mounted in the housing about an axis of the lock cam having a locked and unlocked position;

a motor;

a motor crank arm operatively coupled with each of the motor and the lock cam;

a motor cam clutch operably coupled with the motor and operably interposed between the motor crank arm and the motor;

a deadbolt lock movably mounted in the housing and operatively coupled with each of the lock cam and the motor for shifting between a locked position, wherein the closure is positively retained in the closed position, and an unlocked position, wherein the closure is free to be shifted between the open and closed positions; and an input device operatively connected with the motor, whereby actuation of the input device actuates the motor and contemporaneously shifts the deadbolt lock between the locked and unlocked positions;

wherein a clutch spring is disposed between a stop on the lock cam and an interior backing plate, the clutch spring comprising a central opening that receives a shaft of the lock cam and a pair of opposed radial slots disposed on opposite sides of the central opening of the clutch spring, and the lock cam comprising a corresponding pair of opposed tabs extending radially from the axis of the lock cam proximate an intersection of the shaft and the stop of the lock cam that are disposed to be received by the pair of opposed radial slots disposed on opposite sides of the central opening of the clutch spring, wherein the clutch spring is mechanically and operably coupled with the lock cam and rotates in accordance with the rotation of the lock cam.

26. The lock assembly of claim 25, wherein the clutch spring further comprises a pair of opposed circular outer edges extending about an outer periphery of the clutch spring, each of the opposed circular outer edges comprising an outwardly extending detent, and the interior backing plate further comprises a recess axially disposed to receive the shaft, the recess comprising a plurality of slots disposed about and extending radially from the recess, wherein each of the outwardly extending detents on each of the opposed circular outer edges of the clutch spring resiliently engage a one of an opposed pair of slots disposed about the recess in each of the locked and unlocked positions.

27. The lock assembly of claim 25, wherein the clutch spring is fabricated from spring steel.

28. A lock assembly adapted for mounting on an associated closure and the like of the type that can be moved between an open position and a closed position and an opening in the closure extending between an exterior and an interior surface of the closure, the lock assembly comprising:

a housing having an exterior housing plate juxtaposed against the exterior surface of the closure and an interior housing plate juxtaposed against the interior surface of the closure, the exterior and interior housing plates attached one to the other between the exterior and interior surface of the closure;

a handle mounted upon the exterior housing plate of the housing for rotation between a retracted position and an extended position;

a latch plunger operably connected with the handle, and configured such that when the handle is in the retracted position, the latch plunger is in a latched position, wherein the closure cannot be unintentionally shifted from the closed position, and when the handle is in the extended position, the latch plunger is in an unlatched position, wherein the closure is free to be moved from the closed position to the open position;

a key lock mounted on the exterior housing plate of the housing, where the key lock has a locked and an unlocked position;

a lock cam rotatably mounted in the housing and operably connected with the key lock for rotation therewith, the lock cam having a crank arm;

a link operably connected with the crank arm of the lock cam;

a deadbolt lock movably mounted in the housing for shifting between a locked position, wherein the closure is positively retained in the closed position, and an unlocked position, wherein the closure is free to be shifted between the open and closed positions;

the deadbolt lock being operably connected with the link;

a motor operatively connected with the link;

a motor cam clutch operably coupled with the motor and operably interposed between the lock cam and the motor; and an input device operatively connected with the motor, whereby actuation of the motor shifts the deadbolt lock between the locked and unlocked positions.

29. A lock assembly as set forth in claim 28, further comprising a device to sense a position of the lock cam and to determine whether the deadbolt lock has reached the locked or unlocked position.

30. A lock assembly adapted for mounting on an associated closure and the like of the type that can be moved between an open position and a closed position and an opening in the closure extending between an exterior and an interior surface of the closure, the lock assembly comprising:

a housing having an exterior housing plate juxtaposed against the exterior surface of the closure and an interior housing plate juxtaposed against the interior surface of the closure, the exterior and interior housing plates attached one to the other between the exterior and interior surface of the closure;

a handle mounted upon the exterior housing plate of the housing for rotation between a retracted position and an extended position;

a latch plunger operably connected with the handle, and configured such that when the handle is in the retracted position, the latch plunger is in a latched position, wherein the closure cannot be unintentionally shifted from the closed position, and when the handle is in the extended position, the latch plunger is in an unlatched position, wherein the closure is free to be moved from the closed position to the open position;

a key lock mounted on the exterior housing plate of the housing, where the key lock has a locked and an unlocked position;

a lock cam rotatably mounted in the housing and operably connected with the key lock for rotation therewith, the lock cam having a crank arm;

a link operably connected with the crank arm of the lock cam;

a deadbolt lock movably mounted in the housing for shifting between a locked position, wherein the closure is positively retained in the closed position, and an unlocked position, wherein the closure is free to be shifted between the open and closed positions;

the deadbolt lock being operably connected with the link;

a motor operatively connected with the link;

a motor cam clutch operably coupled with the motor and operably interposed between the lock cam and the motor;

a device to sense a position of the lock cam and to determine whether the deadbolt lock has reached the locked or unlocked position; and an input device operatively connected with the motor, whereby actuation of the motor shifts the deadbolt lock between the locked and unlocked positions;

wherein the device to sense the position of the lock cam and to determine whether the lock cam is in the locked or unlocked position includes a pair of micro switches mounted such that when the lock cam is rotated to one of the locked or unlocked positions, a cam on the lock cam depresses one of the pair of micro switches for determining whether the deadbolt lock has reached the locked or unlocked position.

31. A lock assembly as set forth in claim 30, wherein after the deadbolt lock has reached the locked or unlocked position, the direction of motor rotation is reversed and the motor cam clutch and lock cam are rotated a predetermined interval after the cam on the lock cam depresses one of the pair of micro switches for determining whether the deadbolt lock has reached the locked or unlocked position.

32. The lock assembly of claim 31, wherein the predetermined interval is between 35 and 45 degrees.

* * * * *